US010733947B2

(12) United States Patent
McElvain

(10) Patent No.: US 10,733,947 B2
(45) Date of Patent: Aug. 4, 2020

(54) COMPENSATION FOR LIQUID CRYSTAL DISPLAY RESPONSE VARIATIONS UNDER HIGH BRIGHTNESS LIGHT FIELDS

(71) Applicant: Dolby Laboratories Licensing Corporation, San Francisco, CA (US)

(72) Inventor: Jon S. McElvain, Manhattan Beach, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/095,932

(22) PCT Filed: Jun. 20, 2017

(86) PCT No.: PCT/US2017/038357
§ 371 (c)(1),
(2) Date: Oct. 23, 2018

(87) PCT Pub. No.: WO2017/223100
PCT Pub. Date: Dec. 28, 2017

(65) Prior Publication Data

US 2019/0139504 A1 May 9, 2019

Related U.S. Application Data

(60) Provisional application No. 62/352,677, filed on Jun. 21, 2016.

(30) Foreign Application Priority Data

Jun. 21, 2016 (EP) ..... 16175498

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3426* (2013.01);
(Continued)

(58) Field of Classification Search
None
See application file for complete search history.

(56) References Cited

U.S. PATENT DOCUMENTS 5,489,918 A 2/1996 Mosier
6,496,177 B1 12/2002 Burton
(Continued)

FOREIGN PATENT DOCUMENTS

JP 2009157306 7/2009
JP 2015-215518 12/2015
(Continued)

OTHER PUBLICATIONS

Cho, Daeyoun, et al "A Novel Adaptive Dimming LED Backlight System with Current Compensated X-Y Channel Drivers for LCD TVs" vol. 7, Issue 1, pp. 29-35, Jan. 17, 2011.
(Continued)

*Primary Examiner* — Aneeta Yodichkas

(57) ABSTRACT

A method for compensation of liquid crystal display response variations in high brightness fields, comprising receiving an image signal having a set of initial liquid crystal display code values for a region, estimating individual backlight power levels for the region of the image signal, determining a combined backlight power level based on the individual backlight power levels of the region, determining at least one change in transmittance based on the combined backlight power level of the region and correcting the set of initial liquid crystal display code values based in the determined at least one change in transmittance.

14 Claims, 37 Drawing Sheets

(52) U.S. Cl.
CPC ... *G09G 3/3607* (2013.01); *G09G 2320/0242* (2013.01); *G09G 2320/0276* (2013.01); *G09G 2320/0285* (2013.01); *G09G 2320/0646* (2013.01); *G09G 2320/0673* (2013.01); *G09G 2360/16* (2013.01)

(56) References Cited

U.S. PATENT DOCUMENTS

| | | | | |
|---|---|---|---|---|
| 2002/0122022 | A1 | 9/2002 | Tze | |
| 2003/0067435 | A1 | 4/2003 | Liu | |
| 2005/0248520 | A1* | 11/2005 | Feng | G09G 3/3426 345/87 |
| 2006/0238551 | A1 | 10/2006 | Dalal | |
| 2006/0274026 | A1 | 12/2006 | Kerofsky | |
| 2007/0152949 | A1 | 7/2007 | Sakai | |
| 2008/0150880 | A1 | 6/2008 | Inuzuka | |
| 2008/0297451 | A1 | 12/2008 | Marcu | |
| 2009/0109232 | A1 | 4/2009 | Kerofsky | |
| 2009/0122001 | A1 | 5/2009 | Cheung | |
| 2009/0160877 | A1 | 6/2009 | Peng | |
| 2010/0053222 | A1 | 3/2010 | Kerofsky | |
| 2010/0182346 | A1 | 7/2010 | Sano | |
| 2011/0141154 | A1 | 6/2011 | Ahn | |
| 2011/0199401 | A1 | 8/2011 | Fujiwara | |
| 2012/0281028 | A1 | 11/2012 | Orlick | |
| 2013/0120234 | A1 | 5/2013 | Atkins | |
| 2013/0249932 | A1 | 9/2013 | Siotis | |

FOREIGN PATENT DOCUMENTS

| | | |
|---|---|---|
| WO | 2011048635 | 4/2011 |
| WO | 2015092952 | 6/2015 |

OTHER PUBLICATIONS

Xue, Liqin, et al "Dynamic Segmentation for a Side Lit Backlight System" IEEE Fifth International Conference on Advanced Computational Intelligence, pp. 1145-1148, Oct. 18-20, 2012.

* cited by examiner

1100

1200

1700

COMPENSATION FOR LIQUID CRYSTAL DISPLAY RESPONSE VARIATIONS UNDER HIGH BRIGHTNESS LIGHT FIELDS

CROSS REFERENCE TO RELATED APPLICATIONS

The present application claims benefit of and claims priority to U.S. Provisional Application No. 62/352,677 and European Patent Application No. 16175498.1, both filed on Jun. 21, 2016, the disclosures of which are incorporated herein by reference in their entirety.

TECHNOLOGY

The present disclosure relates generally to liquid crystal displays (LCDs). More particularly, an embodiment of the present disclosure relates to gamma correction of liquid crystal displays.

BRIEF DESCRIPTION OF THE DRAWINGS

An embodiment of the instant disclosure is illustrated by way of example, and not in way by limitation, in the figures of the accompanying drawings and in which like reference numerals refer to similar elements and in which.

SUMMARY

Figure 1:
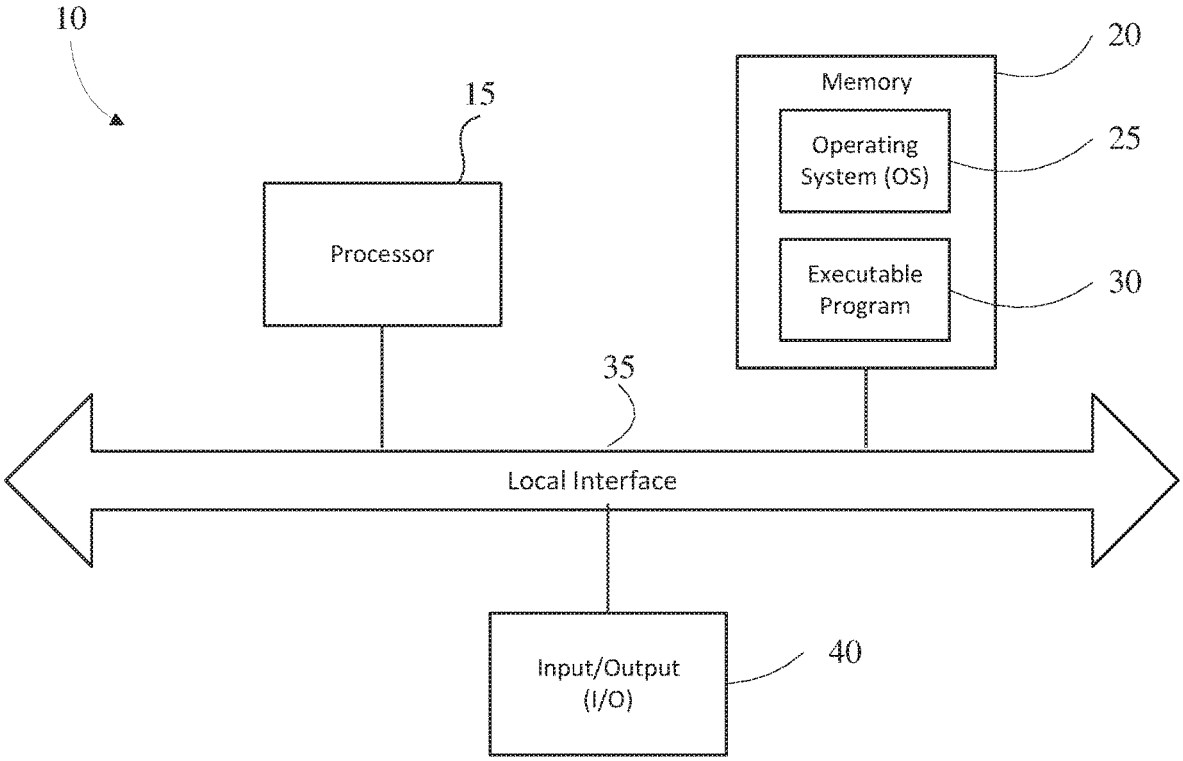
FIG. 1 depicts a first example system in in accordance with an embodiment of the disclosure.
Figure 2:
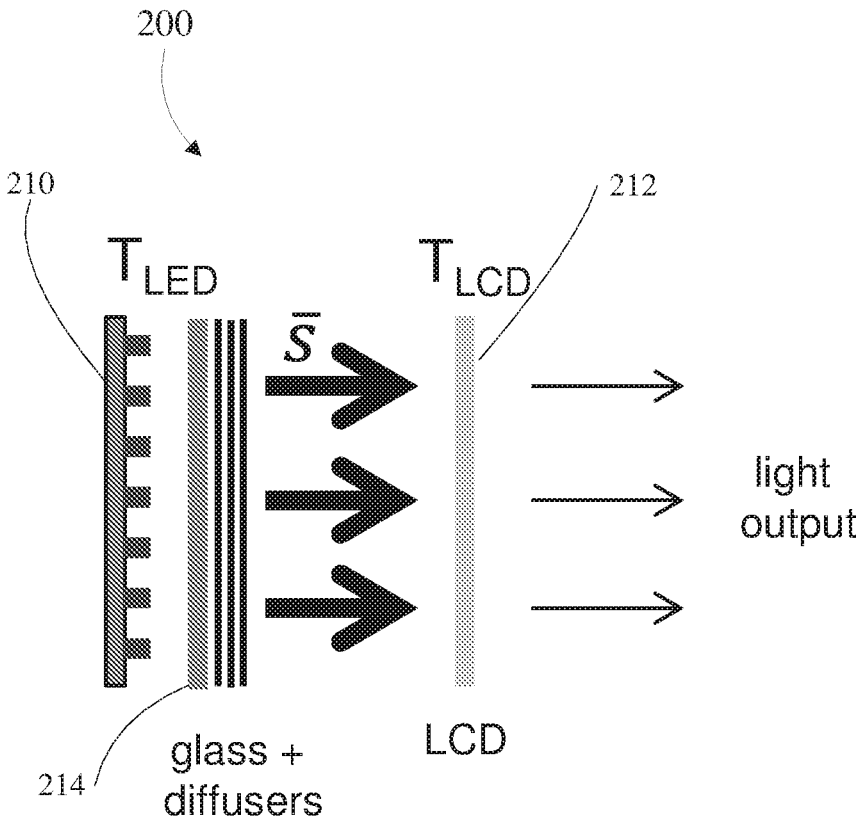
FIG. 2 depicts a light emitting diode liquid crystal display (LCD) in accordance with an embodiment of the disclosure.

In a first aspect of the disclosure, a method for compensation of liquid crystal display response variations in high brightness fields, comprising receiving an image signal having a set of initial liquid crystal display code values for a region, estimating individual backlight power levels for the region of the image signal, determining a combined backlight power level based on the individual backlight power levels of the region, determining at least one change in transmittance based on the combined backlight power level of the region and correcting the set of initial liquid crystal display code values based in the determined at least one change in transmittance.

In a second aspect of the disclosure, a method for compensation of liquid crystal display response variations in high brightness fields, comprising receiving an image signal having a set of initial liquid crystal display code values for a region, estimating individual backlight power levels for the region, determining a combined backlight power level based on the individual backlight power levels of the region, determining at least one delta change in transmittance based on the combined backlight power level of the region and a reference power and correcting the set of initial liquid crystal display code values based in the determined at least one delta change in transmittance.

In a third aspect of the disclosure, a method for compensation of liquid crystal display response variations in high brightness fields, comprising receiving an image signal, estimating a plurality of colors for a region of the image signal, estimating a plurality of backlight power levels for the region, measuring the transmittance for the plurality of colors and the plurality of backlight power levels and modelling the measured transmittance.

In a fourth aspect of the disclosure, an apparatus that compensates for liquid crystal display response variations in high brightness fields, comprising an optical power measurement device coupled to a local backlight array of the liquid crystal display, a compensation module coupled to the optical power measurement device and the liquid crystal display, wherein the compensation module adjusts a set of initial liquid crystal display code values based on a measured optical power.

In a fifth aspect of the disclosure, an apparatus that compensates for liquid crystal display response variations in high brightness fields, comprising a reflected optical power measurement device coupled to a local backlight array of the liquid crystal display, a compensation module coupled to the reflected optical power measurement device and the liquid crystal display, wherein the compensation module and modulates a set of initial liquid crystal display code values based on a reflected optical power.

In a fifth aspect of the disclosure, a method, in a display comprising an LCD modulator and a backlight, of controlling the LCD modulator. The method comprises receiving an image signal comprising an LCD code value for setting a transmittance level of at least a part of the LCD modulator, wherein the received LCD code value corresponds to a target transmittance level on a first response curve of said at least a part of the LCD modulator, the first response curve giving transmittance levels as a of function LCD code values for said at least a part of the LCD modulator when illuminated by at least a part of the backlight at a reference output level thereof. The method further comprises obtaining an output level value of said at least a part of the backlight. The method further comprises determining an adapted LCD code value as a function of the received LCD code value and the obtained output level value, such that the adapted LCD code value corresponds to the target transmittance level on a second response curve of said at least a part of the LCD modulator, the second response curve giving transmittance levels as a function of LCD code values for said at least a part of the LCD modulator when illuminated by said at least a part of the backlight at the obtained output level. The method further comprises setting the transmittance level of said at least a part of the LCD modulator according to the adapted LCD code value.

The backlight, e.g. an LED panel, may comprise an emissive area made up of a plurality of emissive regions which together form the entire emissive area. In which case, 'at least a part of the backlight' may refer inter alia to one of the emissive regions, a plurality of adjacent ones of the emissive regions or the entire emissive area.

The LCD modulator may comprise a transmissive area made up of a plurality of transmissive regions which together form the entire transmissive area. In which case, 'at least a part of the LCD modulator' may refer inter alia to one of the transmissive regions, a plurality of adjacent ones of the transmissive regions or the entire transmissive area. The transmissive regions of the LCD modulator may each be positioned in front of one or more of the emissive regions of the backlight.

The first and second response (or gamma) curves may be predetermined, e.g. through experimentation. The first and second response curves may belong to a set including respective response curves (which are characteristic curves of the LCD modulator) for a plurality of different backlight levels. The plurality of different backlight levels may include all the possible backlight levels, or just a representative sample (or some other suitable subset) of all the possible backlight levels.

In some embodiments, the adapted LCD code value is determined as a monotonically decreasing function of the obtained output level of said at least a part of the backlight. In some LCD modulators, transmittance increases with backlight output level. In the control of such LCD modulators, therefore, the adapted LCD code values monotonically decrease with backlight output level. For example, for the same received LCD code value, a decrease in backlight output level will result in the adapted LCD code value being the same or lower.

In some embodiments, the adapted LCD code value is determined as a monotonically increasing function of the obtained output level of said at least a part of the backlight. In some LCD modulators, transmittance decreases with backlight output level. In the control of such LCD modulators, therefore, the adapted LCD code values monotonically increase with backlight output level. For example, for the same received LCD code value, an increase in backlight output level will result in the adapted LCD code value being the same or higher.

In some embodiments, the obtained output level value of said at least a part of the backlight represents an estimated power level of said at least a part of the backlight. The skilled person will recognize numerous suitable methods of estimating the power level of said at least a part of the backlight. These methods may involve the use of suitable measurement devices, e.g. devices which sense direct or reflected light emitted by the backlight.

DESCRIPTION OF EXAMPLE EMBODIMENTS

The majority of display monitors in use today have a thin film transistor (TFT)-based liquid crystal display (LCD) panel and an emissive backlight. Originally the backlight was a set of fluorescent tubes directly behind the LCD panel, separated by an air space and having a diffuser plate. Light Emitting Diodes (LEDs) replaced the fluorescent tubes, and in early consumer instantiations consisted of a rectangular array of LEDs in conjunction with diffuser plates to allow for a higher spatial uniformity of the light emission field. In this case the LED drive levels were controlled to produce a uniform light field similar to that found in systems utilizing fluorescent tubes in the back plane.

Developed in parallel with LED-based LCD monitors were organic light emitting diode (OLED) monitors. An organic LED forms each individual pixel giving the screens a very high contrast ratio, the downside was that lifetimes were low and cost was high.

LED-based LCD display manufacturers further increased the light density per pixel by adding more LEDs in the backplane. Furthermore, display processing pipelines began to control the backplane LEDs individually in order to produce a higher local brightness. This increase in light density per unit area of the monitor came at the expense of thermal hotspots.

Liquid crystal materials are not immune to changes in temperature. This increase in local light energy intensity led to an increase in local temperature which led ultimately to a variation in the response of the liquid crystal material.

Depending on the underlying LCD technology used, in some cases the response curve yielded an increased LCD transmittance with increased temperature and with others the response curve yielded a decreased transmittance with increased temperature. So that, the very attributes that were being sought, such as higher color saturation, higher brightness and higher contrast, came at the expense of a varying gamma response across the face of the monitor. This systemic variation driven by the increase in localized energy is one item being addressed in the current disclosure. How to retain the benefits of greater color saturation, brightness and contrast, while still ensuring a uniform and predictable light output from the LCD-based monitor.

The use of liquid crystal display (LCD) technology is now ubiquitous in the consumer and professional monitor domains. In the most straightforward display implementations using LCDs, a uniform and generally large area back light is used in conjunction with a transmissive LCD panel that modulates the image based on the addressable pixel resolution of that panel.

More sophisticated instantiations may be found that utilize an emissive back plane that may itself be spatially modulated in a complimentary fashion with the LCD pixels. This method, known as dual-modulation, is capable of delivering higher levels of local contrast, and may be found in consumer televisions which may have four or more individual zones to professional products having 1500-6000 zones. In some cases, contrast ratios in excess on 20000:1 may be achieved using this method.

It is well known that switching response time of liquid crystal materials is dependent on temperature, and that has a direct impact on the transmissive response vs. drive level. LCD systems are fundamentally driven using periodic temporal signals, and changes in rise and fall times will impact the amount of light is transmitted, and this will change the effective gamma behavior of the system. For high dynamic range dual-modulation display systems, the LCD panels are subjected to a much higher light intensity from the back plane.

As much of the light is absorbed by the LCD, on the order of 94%, this may lead to significant elevation of local temperatures on the panel itself, which may be correlated to local variations in the light field from the back plane. In addition to the global changes to the panel gamma caused by elevated ambient temperatures, there may also be local changes in gamma induced by hot spots in the back plane image.

Figure 19:
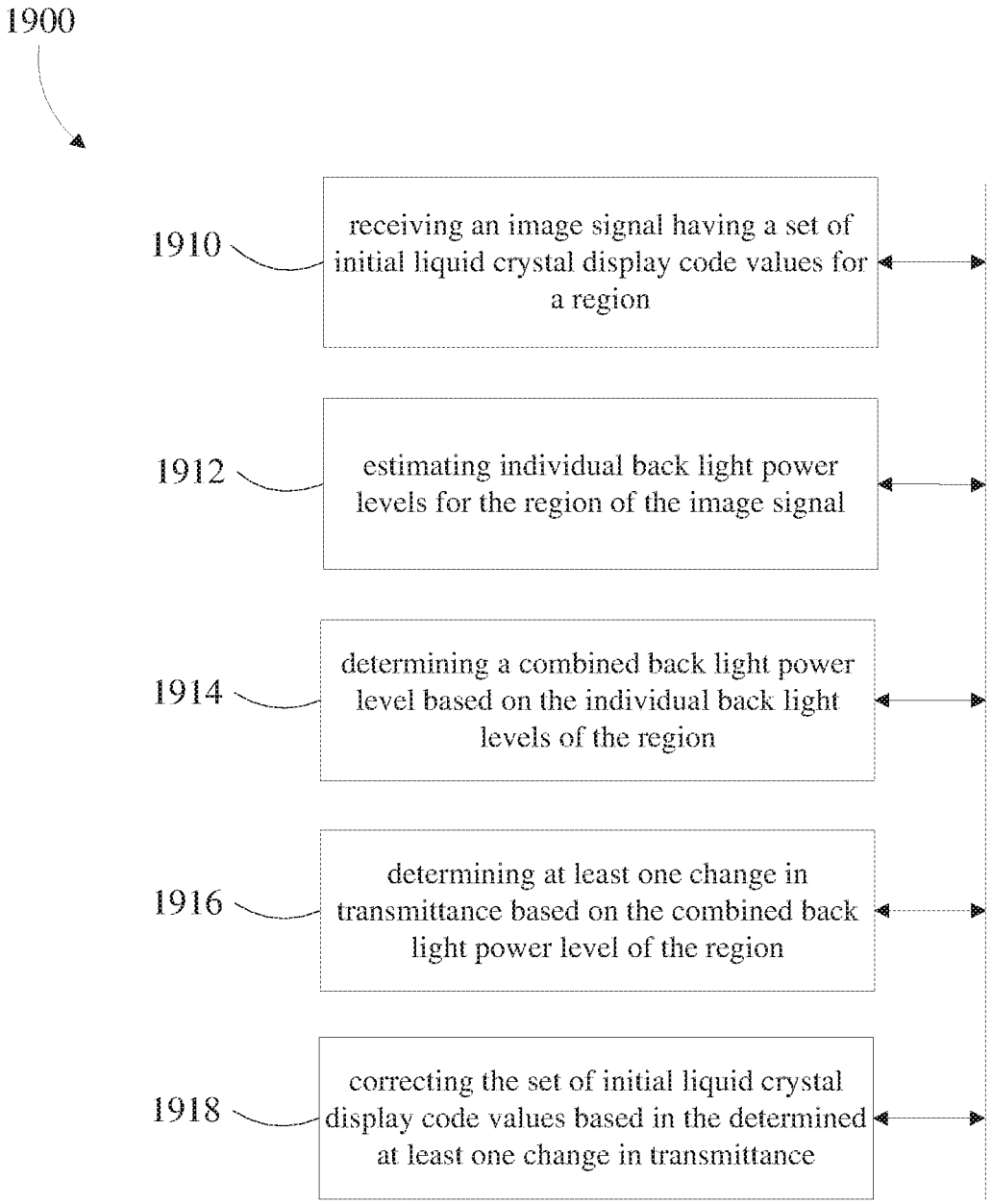
FIG. 19 depicts a first method of compensating LCD gamma in accordance with an embodiment of the disclosure.
Figure 20:
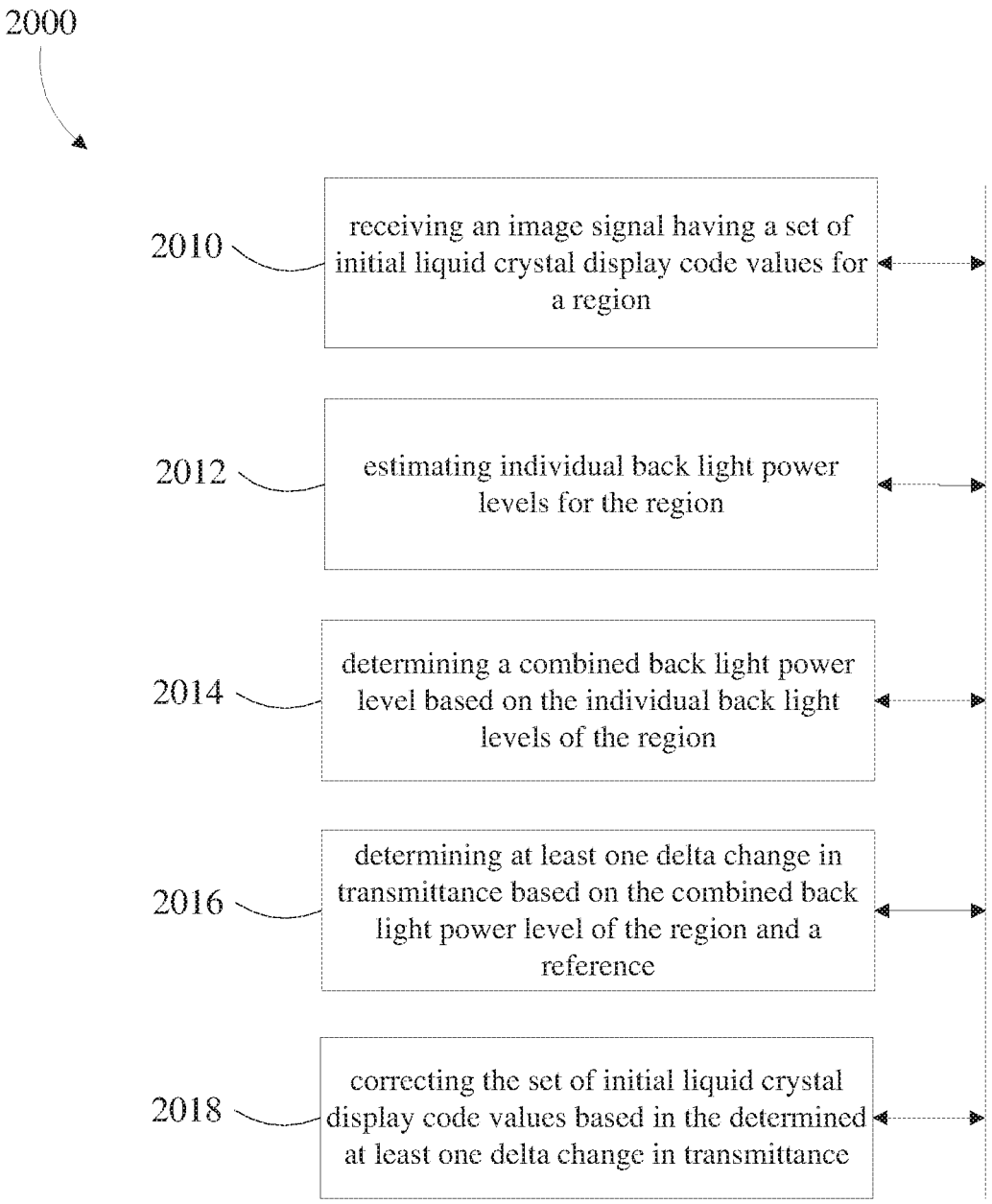
FIG. 20 depicts a second method of compensating LCD gamma in accordance with an embodiment of the disclosure.
Figure 21:
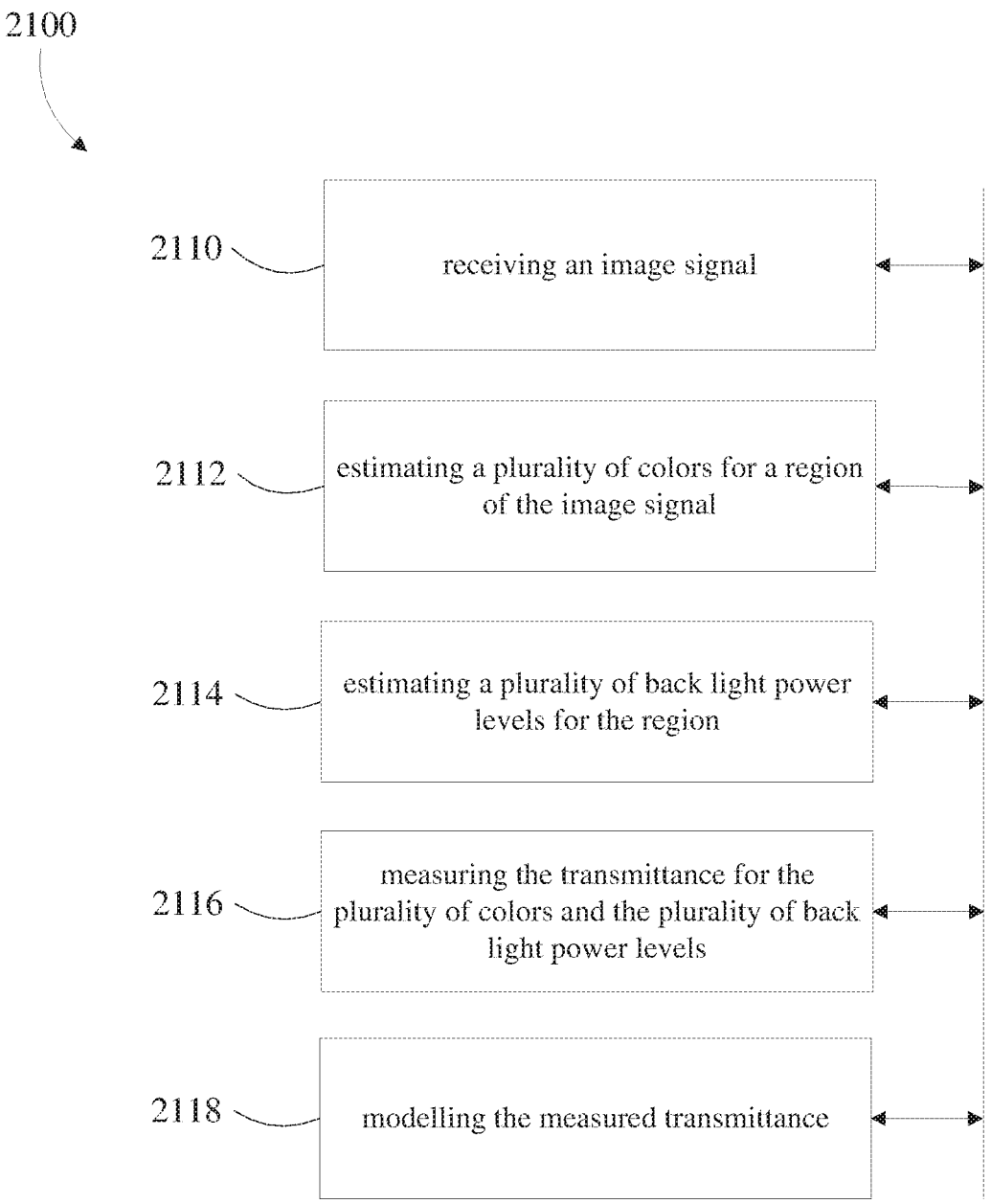
FIG. 21 depicts a third method of compensating LCD gamma in accordance with an embodiment of the disclosure.

FIG. 1 is an exemplary embodiment of a target control hardware (10) (e.g., a computer system) for implementing the embodiments of FIGS. 19-21. This target control hardware comprises a processor (15), a memory bank (20), a local interface bus (35) and one or more Input/Output devices (40). The processor may execute one or more instructions related to the implementation of FIGS. 19-21, and as provided by the Operating System (25) based on some executable program (30) stored in the memory (20). These instructions are carried to the processor (15) via the local interface (35) and as dictated by some data interface protocol specific to the local interface and the processor (15). The local interface (35) is a symbolic representation of several elements such as controllers, buffers (caches), drivers, repeaters and receivers that are generally directed at providing address, control, and/or data connections between multiple elements of a processor based system. In some embodiments the processor (15) may be fitted with some local memory (cache) where it may store some of the instructions to be performed for some added execution speed. Execution of the instructions by the processor may require usage of some input/output device (40), such as inputting data from a file stored on a hard disk, inputting commands from a keyboard, inputting data and/or commands from a touchscreen, outputting data to a display, or outputting data to a Universal Serial Bus (USB) flash drive. In some embodiments, the operating system (25) facilitates these tasks by being the central element to gathering the various data and instructions required for the execution of the program and provide these to the microprocessor. In some embodiments the operating system may not exist, and tasks are under direct control of the processor (15), although the basic architecture of the target control hardware device (10) may remain the same as depicted in FIG. 1. In some embodiments a plurality of processors may be used in a parallel configuration for added execution speed. In such a case, the executable program may be specifically tailored to a parallel execution. Also, in some embodiments the processor (15) may execute part of the implementation of FIG. 11, and some other part may be implemented using dedicated hardware/firmware placed at an Input/Output location accessible by the target control hardware (10) via local interface (35). The target control hardware (10) may include a plurality of executable programs (30), which may run independently or in combination with one another.

In the domain of temperature-based correction, prior implementations were directed mainly toward compensation of LCD systems in order to produce a controllable contrast, or gamma, across a range of temperatures. These typically involve utilization of a thermal probe near the LCD, such that the resulting measurement is used to adjust the bias voltage of the LCD driver circuit. These methods are global in nature and do not account for spatial variations of temperature due to back light modulation.

In the present disclosure, an efficient method for achieving spatially local adjustments to the LCD response is described, particularly useful for dual-modulation systems where spatial variations in the back plane optical energy are intentionally induced. The description details adjustments to the LCD code values sent to the display, in order to achieve the target transmittance; however, the method may also be applied to spatially-dependent adjustments to the bias voltages.

In this disclosure two display configurations, a type 1 LCD panel and a type 2 LCD panel are depicted, though the configurations share similarities, they also exhibit different responses to high intensity illumination. It is these differences in high intensity illumination response that the current disclosure wishes to address.

As an example, consider the case of a type 1 panel. The LCD transmittance vs. LCD code, in a 10 bit code space, normalized, produces a series of gamma curves for different LED backlight intensities, shown in FIGS. 3-5. As may be seen, for this particular panel model, the effective gamma decreases with increasing LED backplane drive levels. The measurement of LCD transmittance may be performed utilizing a colorimeter or any other light measurement device such as a spectroradiometer.

Figure 3A:
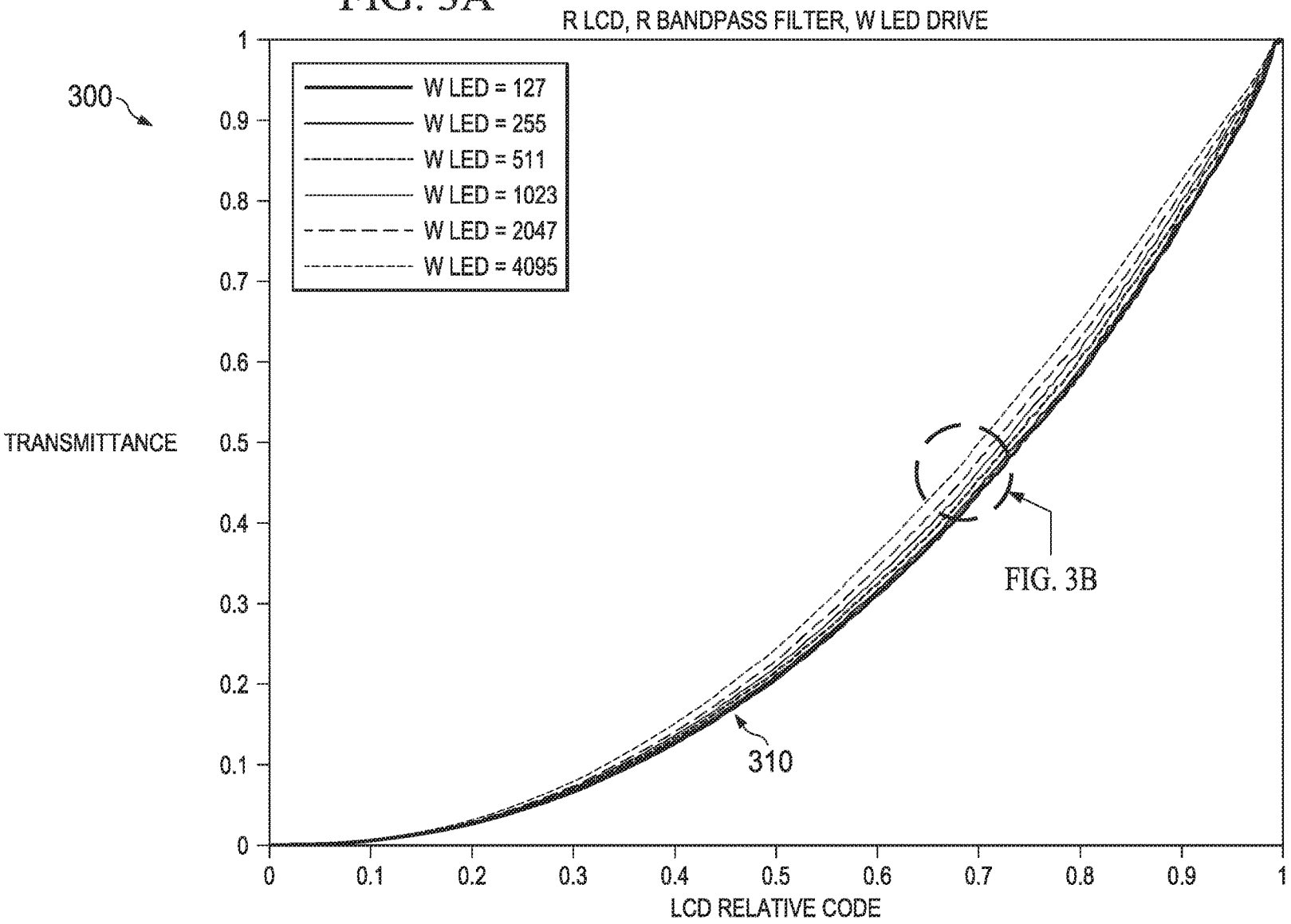
FIGS. 3A and 3B depict a red color output of a type 1 LCD in accordance with an embodiment of the disclosure.
Figure 3B:
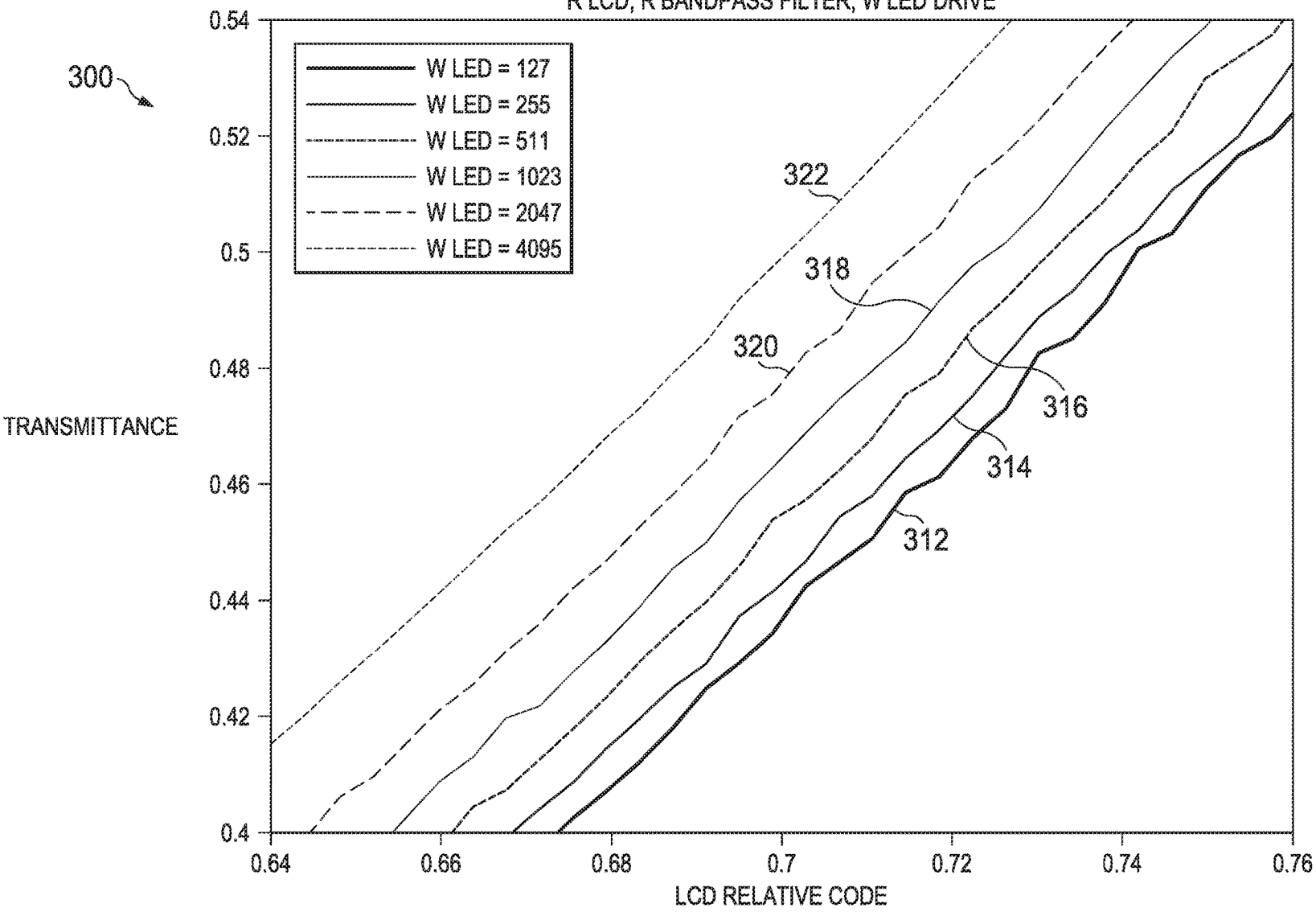
Figure 4A:
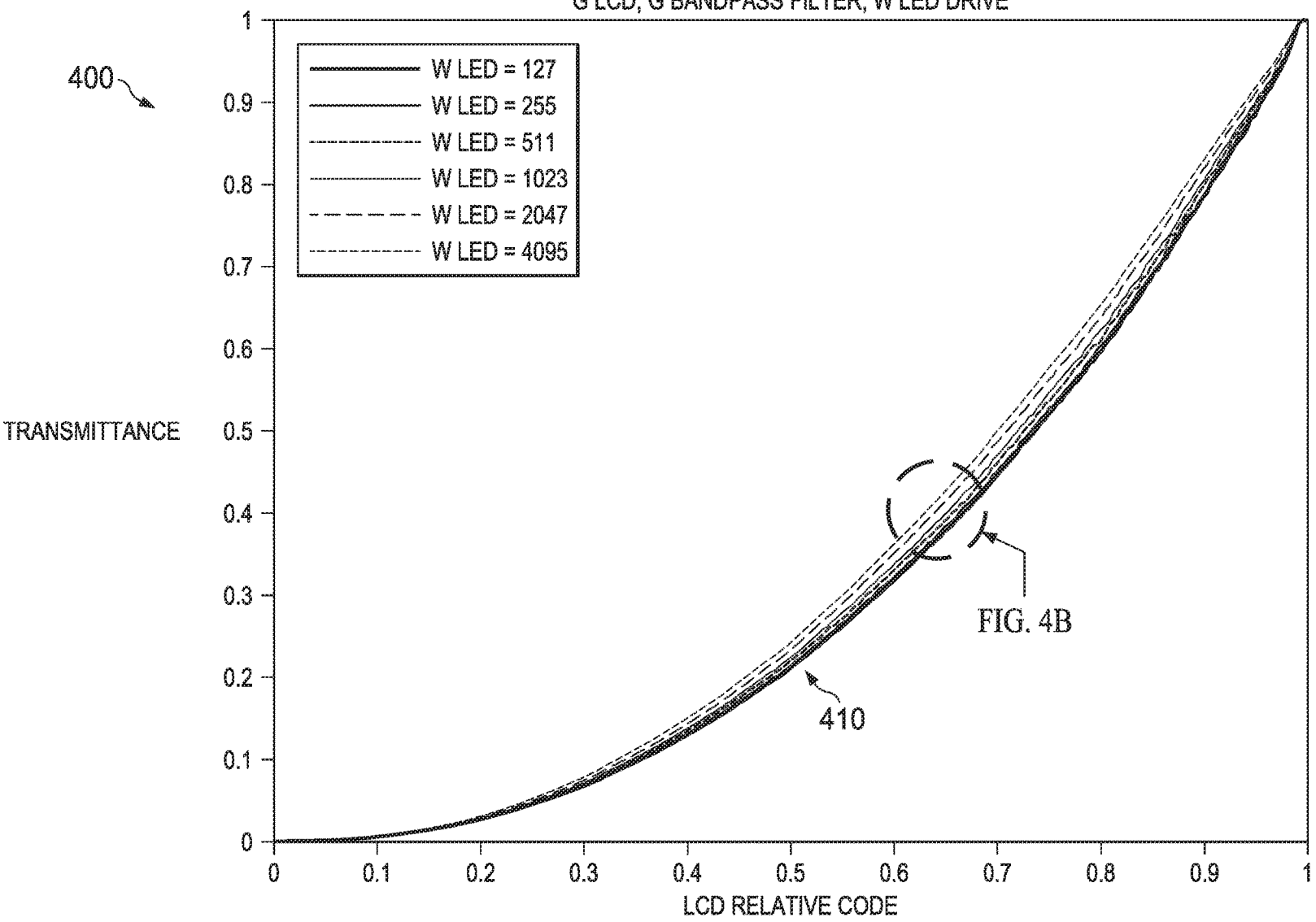
FIGS. 4A and 4B depict a green color output of a type 1 LCD in accordance with an embodiment of the disclosure.
Figure 4B:
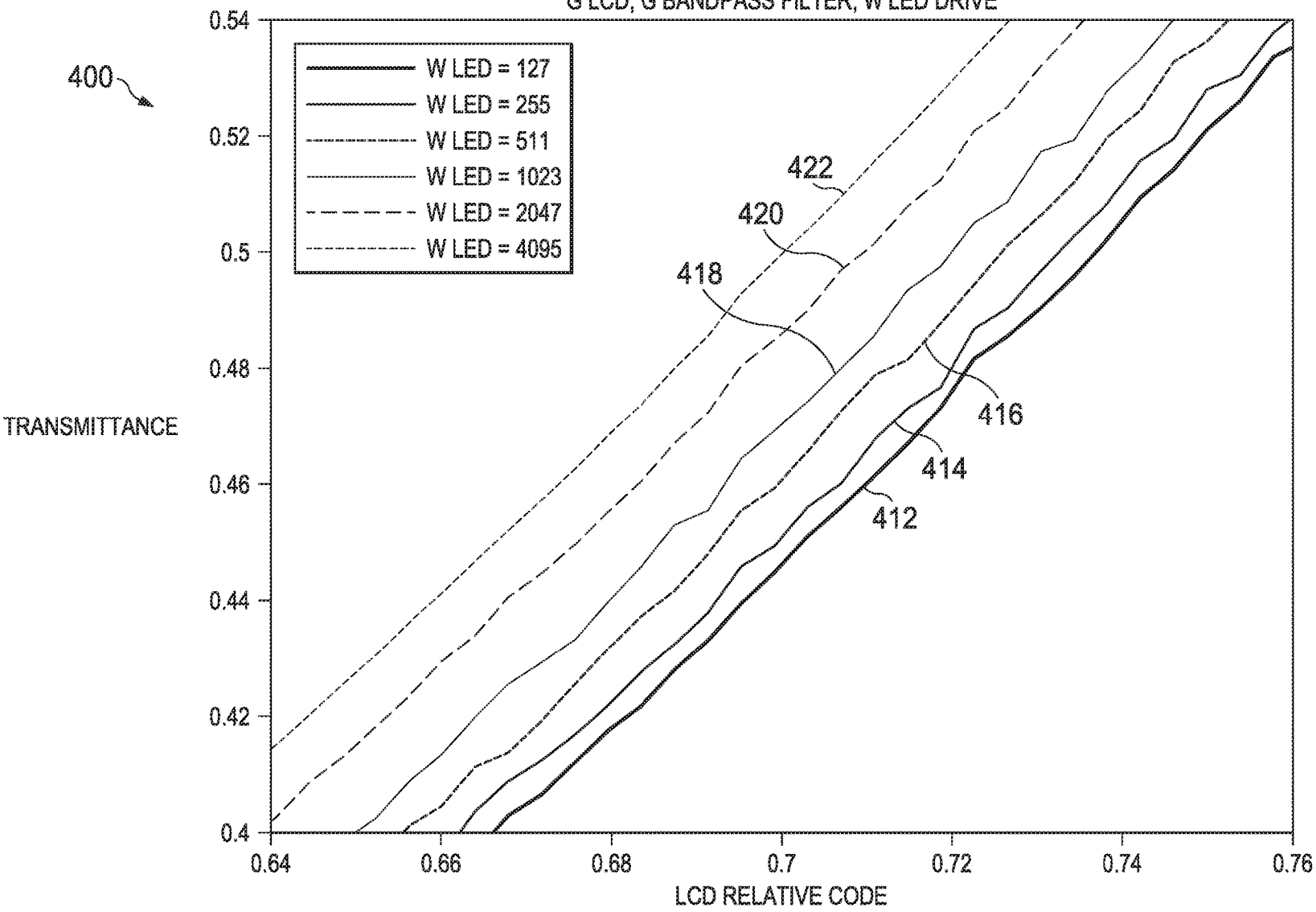
Figure 5A:
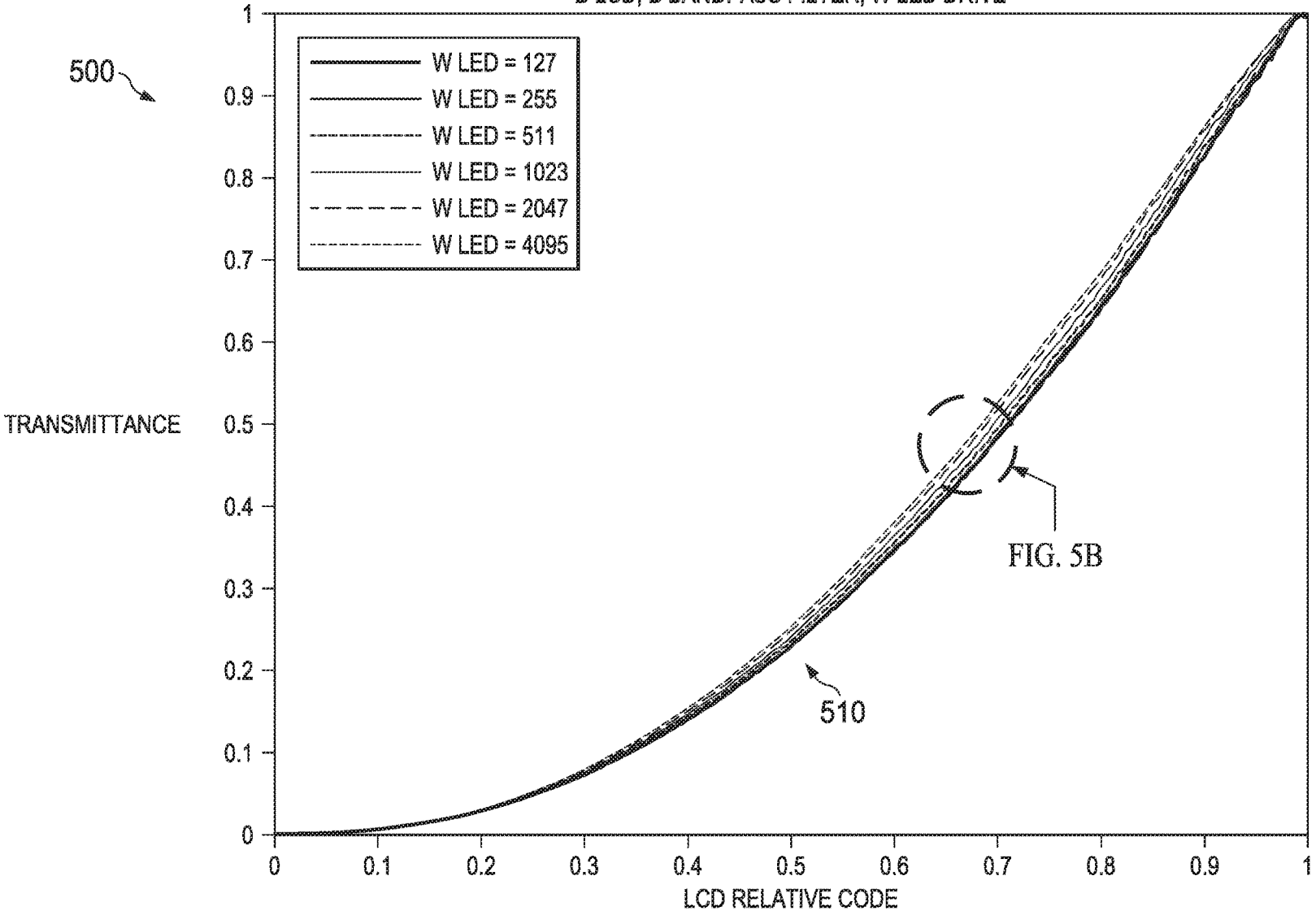
FIGS. 5A and 5B depict a blue color output of a type 1 LCD in accordance with an embodiment of the disclosure.
Figure 5B:
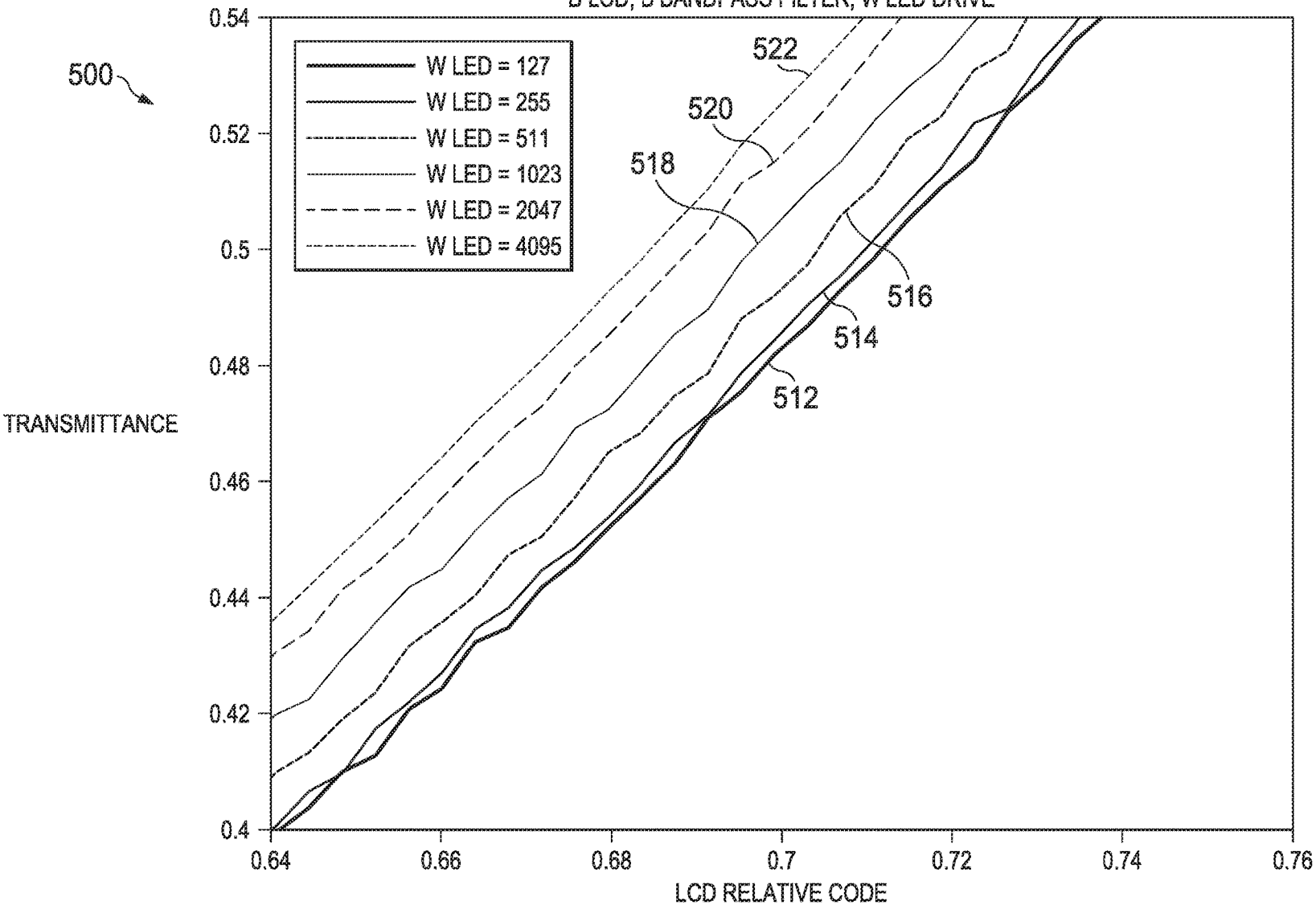

Type 1 LCD panel gamma curves for different LED drive levels show a decrease in effective gamma with increasing LED drive level. FIG. 3 shows red channel LCD response vs. LCD code and a magnified view of R LCD response showing changes for different LED drive levels. FIG. 4 shows green channel LCD response vs. LCD code and a magnified view of G LCD response shows changes for different LED drive levels. FIG. 5 shows blue channel LCD response vs. LCD code and a magnified view of B LCD response indicates changes for different LED drive levels.

FIG. 3 for type 1 monitors for red, WLED at 127 input is 312, WLED at 255 input is 314, WLED at 511 input is 316, WLED at 1023 input is 318, WLED at 2047 input is 320 and WLED at 4095 input is 322.

FIG. 4 for type 1 monitors for green, WLED at 127 input is 412, WLED at 255 input is 414, WLED at 511 input is 416, WLED at 1023 input is 418, WLED at 2047 input is 420 and WLED at 4095 input is 422.

FIG. 5 for type 1 monitors for blue, WLED at 127 input is 512, WLED at 255 input is 514, WLED at 511 input is 516, WLED at 1023 input is 518, WLED at 2047 input is 520 and WLED at 4095 input is 522.

Figure 6A:
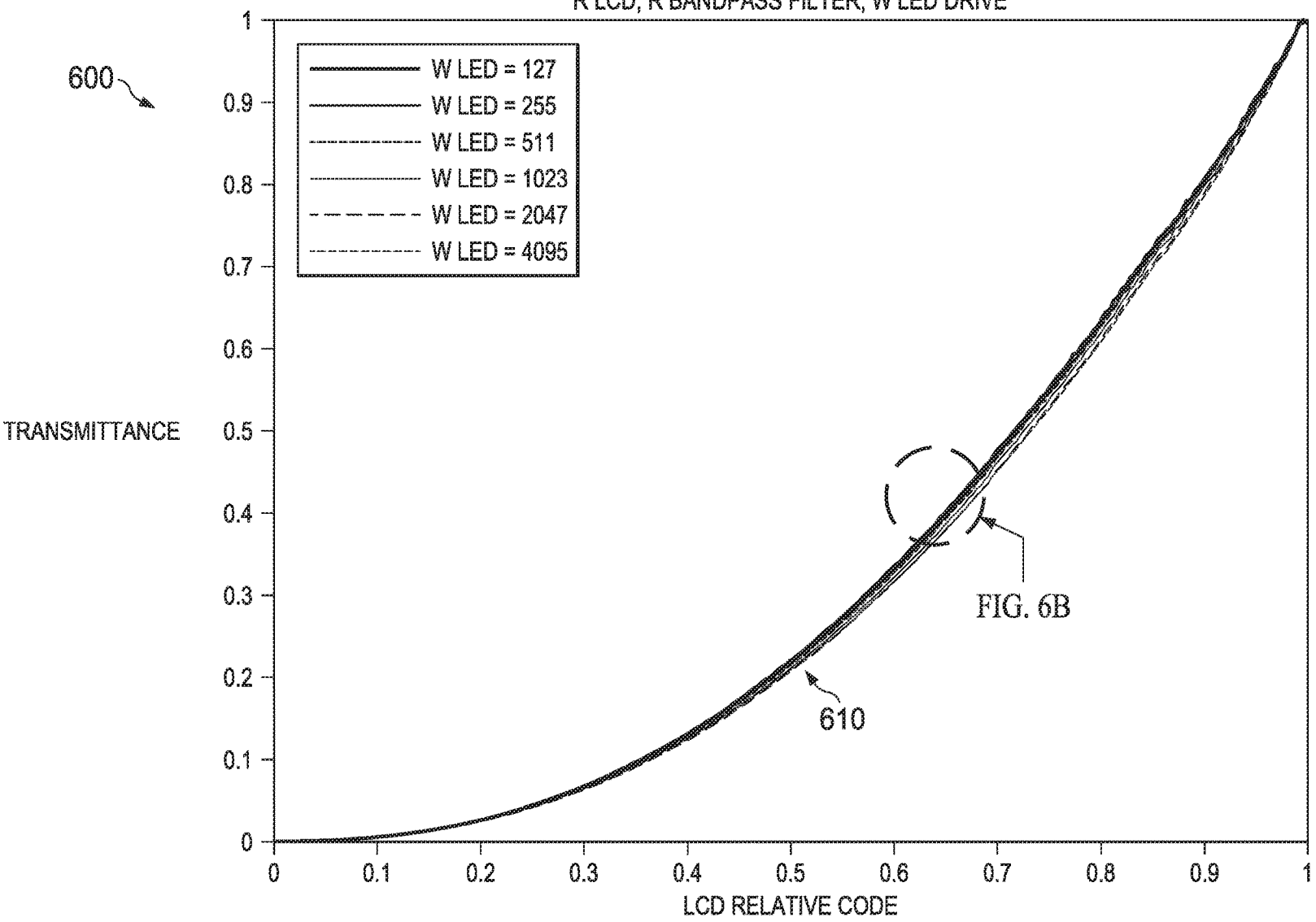
FIGS. 6A and 6B depict a red color output of a type 2 LCD in accordance with an embodiment of the disclosure.
Figure 6B:
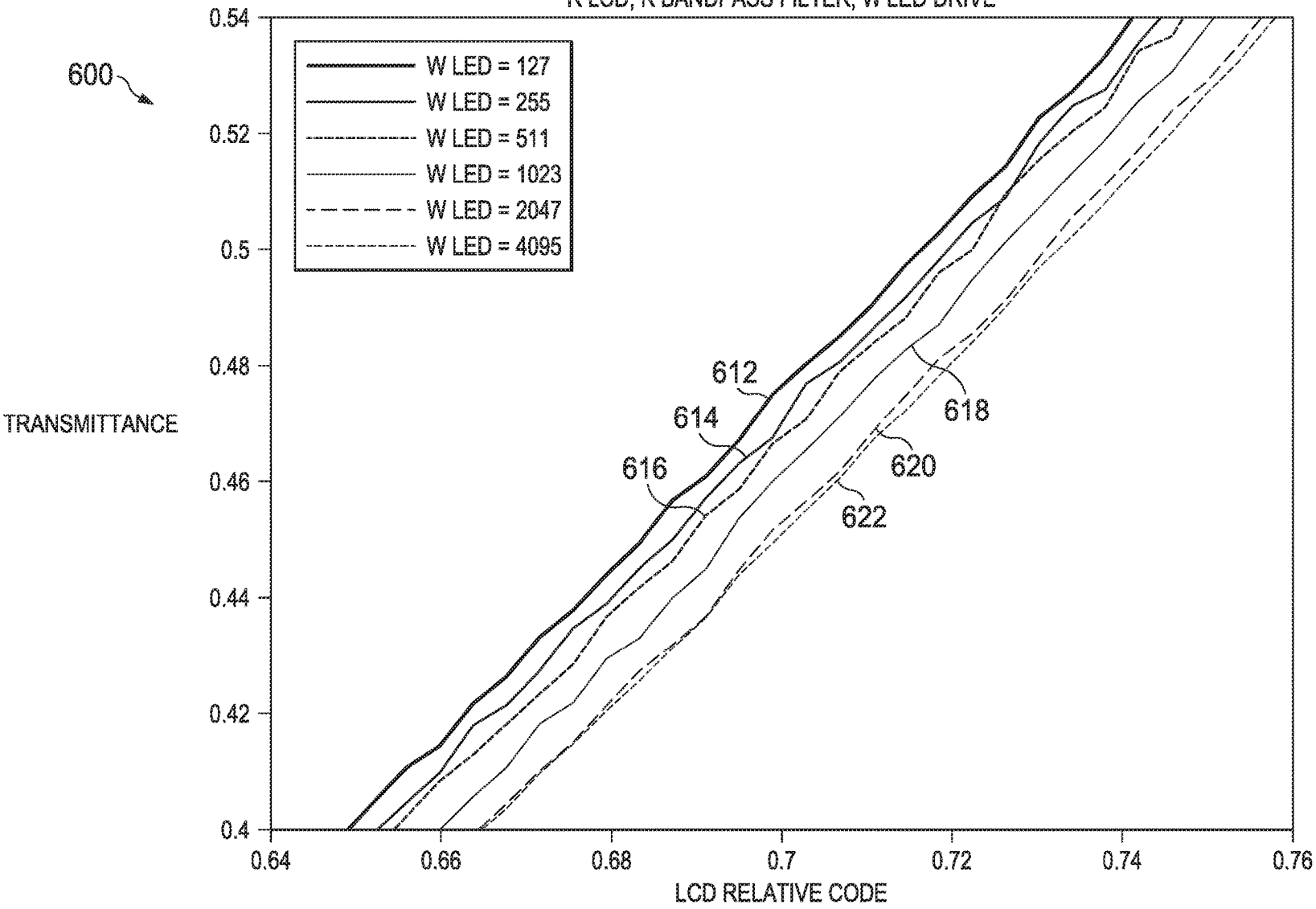
Figure 7A:
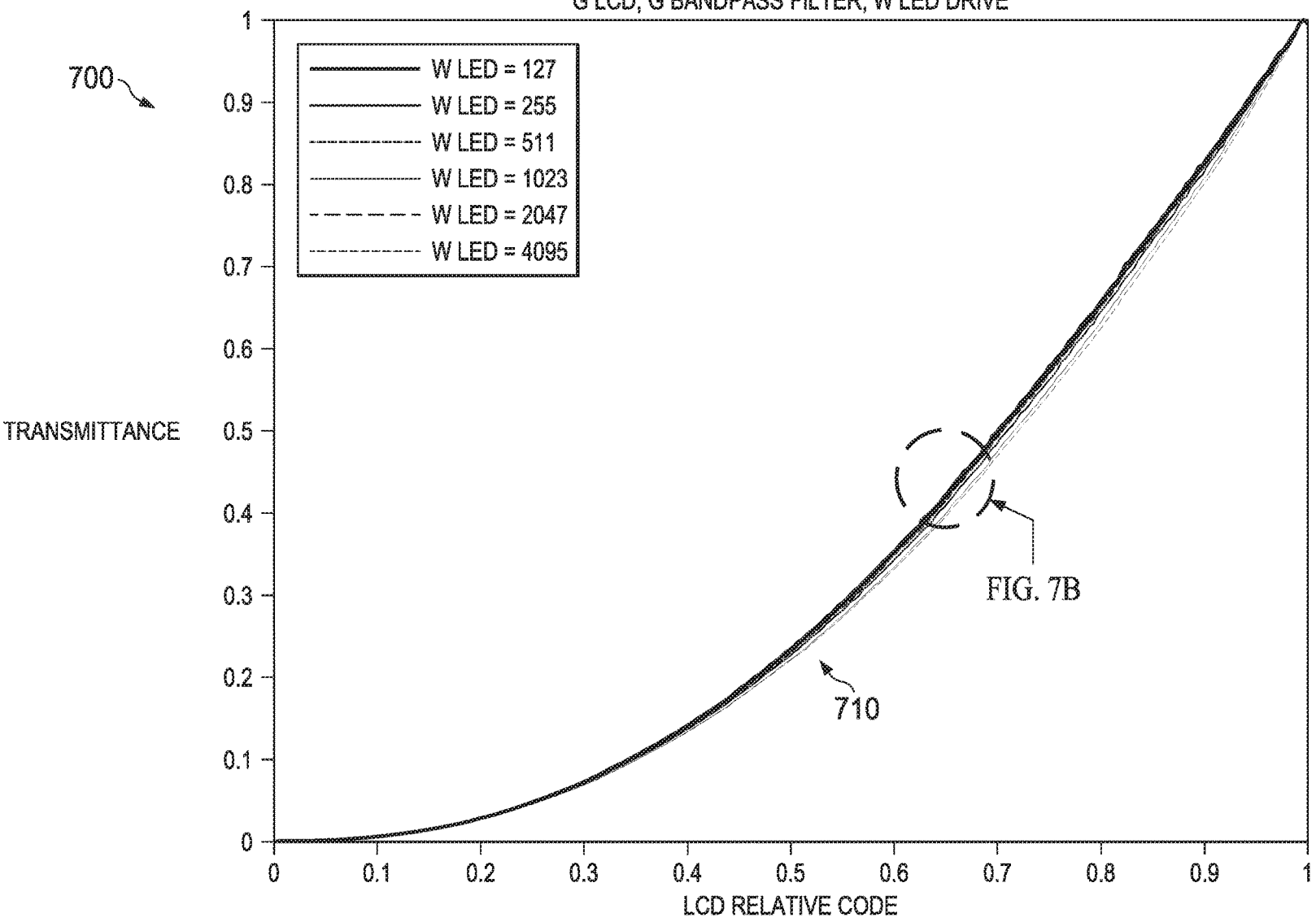
FIGS. 7A and 7B depict a green color output of a type 2 LCD in accordance with an embodiment of the disclosure.
Figure 7B:
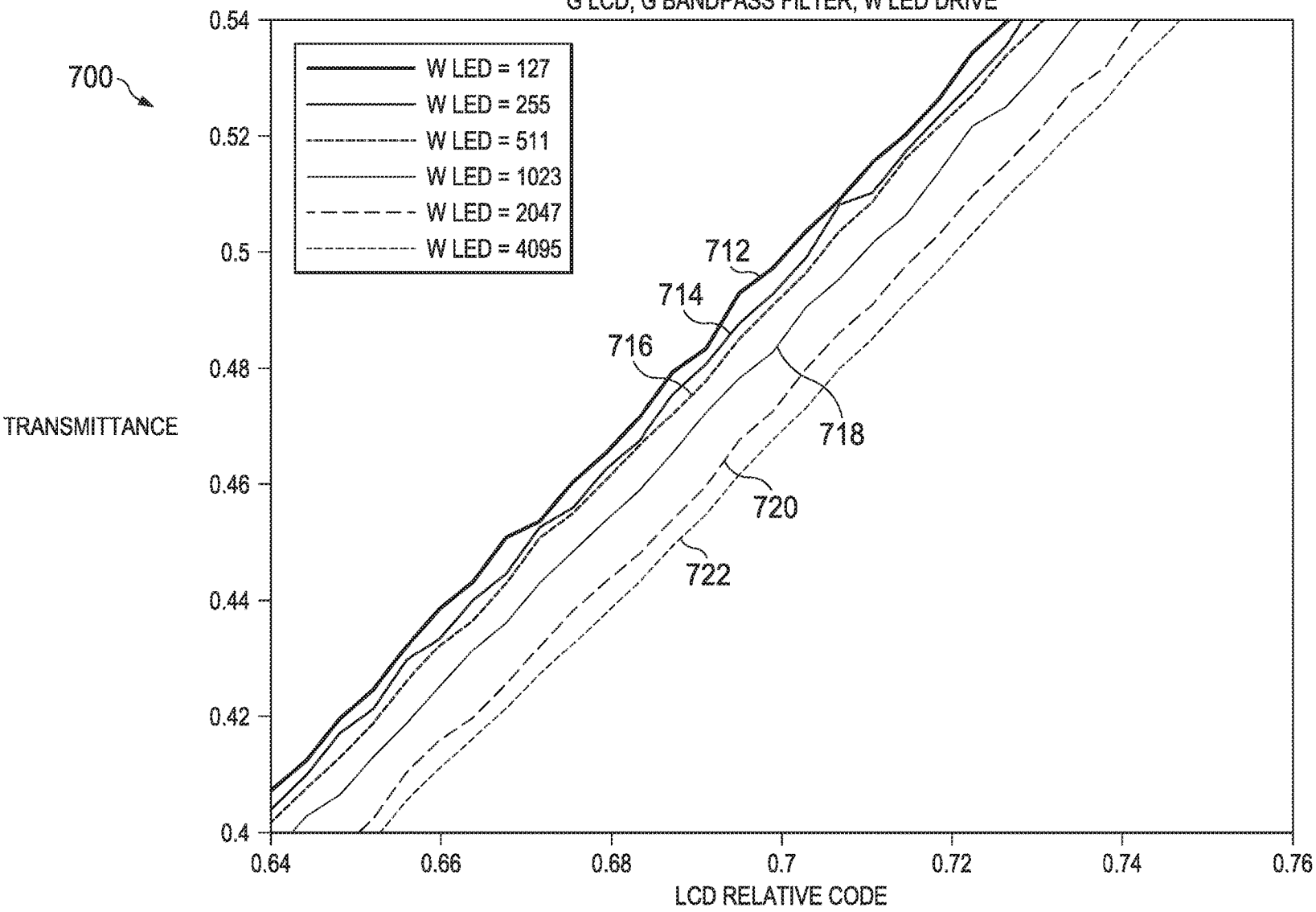
Figure 8A:
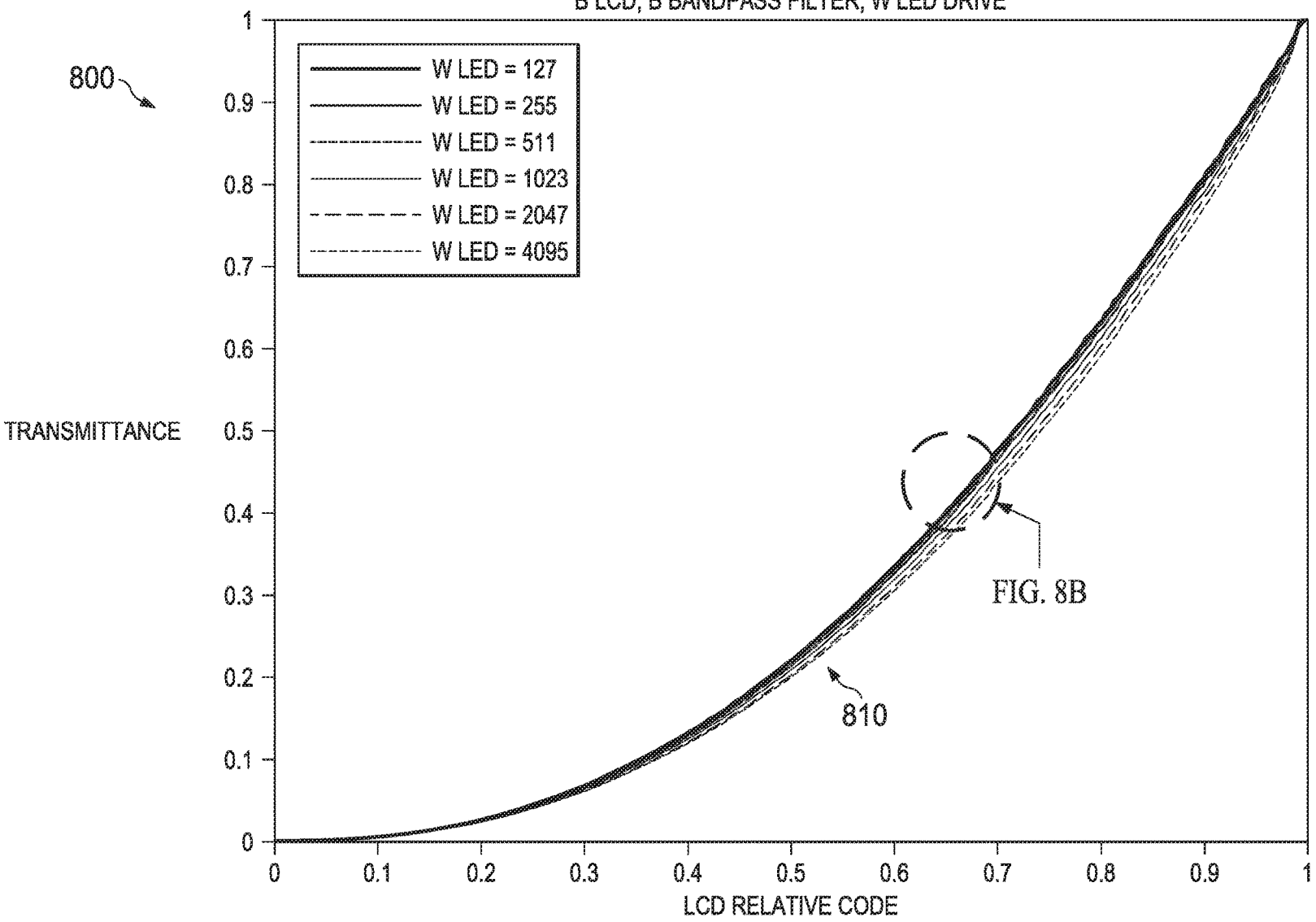
FIGS. 8A and 8B depict a blue color output of a type 2 LCD in accordance with an embodiment of the disclosure.
Figure 8B:
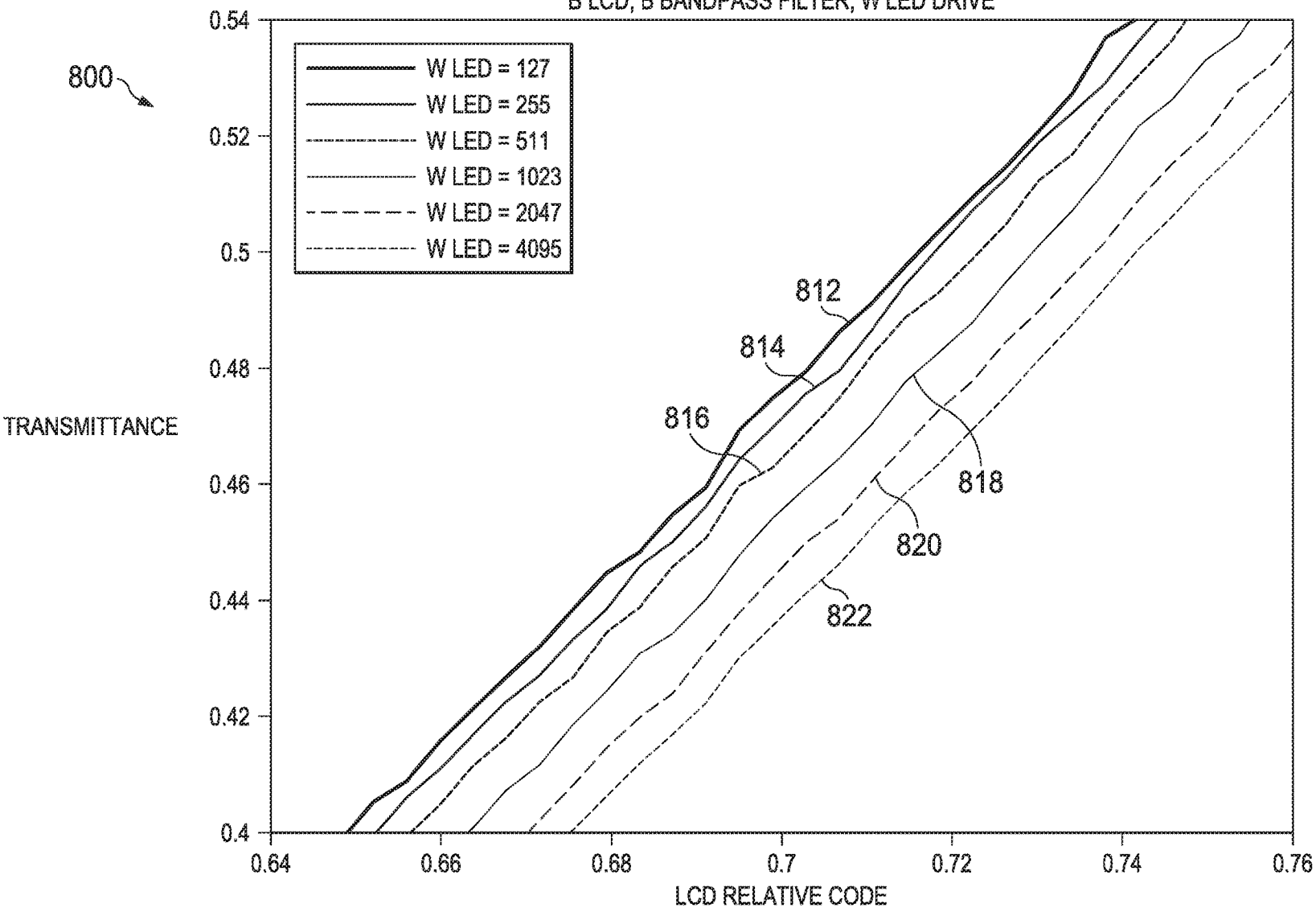

Type 2 LCD panel gamma curves for different LED drive levels show an increase in effective gamma with increasing LED drive level. FIG. 6 shows red channel LCD response vs. LCD code and a magnified view of R LCD response showing changes for different LED drive levels. FIG. 7 shows green channel LCD response vs. LCD code and a magnified view of G LCD response showing changes for different LED drive levels. FIG. 8 shows blue channel LCD response vs. LCD code and a magnified view of B LCD response indicates changes for different LED drives.

FIG. 6 for type 2 monitors for red, WLED at 127 input is 612, WLED at 255 input is 614, WLED at 511 input is 616, WLED at 1023 input is 618, WLED at 2047 input is 620 and WLED at 4095 input is 622.

FIG. 7 for type 2 monitors for green, WLED at 127 input is 712, WLED at 255 input is 714, WLED at 511 input is 716, WLED at 1023 input is 718, WLED at 2047 input is 720 and WLED at 4095 input is 722.

FIG. 8 for type 2 monitors for blue, WLED at 127 input is 812, WLED at 255 input is 814, WLED at 511 input is 816, WLED at 1023 input is 818, WLED at 2047 input is 820 and WLED at 4095 input is 822.

In the case of a type 2 LCD panel, the measurements yield a different result. The effective gamma for this LCD panel model increases with increasing LED drive levels, as shown in FIGS. 6-8. For the purposes of correction of these artifacts, it is beneficial to model these response curve deviations vs. drive, and in particular, have a model that describes the behavior exhibited by type 1 and type 2 LCD panels.

The plots from FIGS. 3-8 may be recast to represent the differential change in LCD response vs. LCD code for different backlight levels. The baseline response is that measured for the lowest back light levels, with the assumption that light-induced thermal effects are minimal in this domain. The following ratios are considered:

$$F_{rel}^{i}(c_i, \vec{s}) \equiv \frac{T^i(c_i, \vec{s})}{T_o^i(c_i)},$$

where $T^i(c_i, \vec{s})$ is the measured transmittance for channel i for LCD code $c_i$ and LED power vector $\vec{s}$ (R, G, B LED channels). $T_o^i(c_i)$ is the LCD response for the lowest backlight drive level, and is assumed to be the reference response.

Figure 9A:
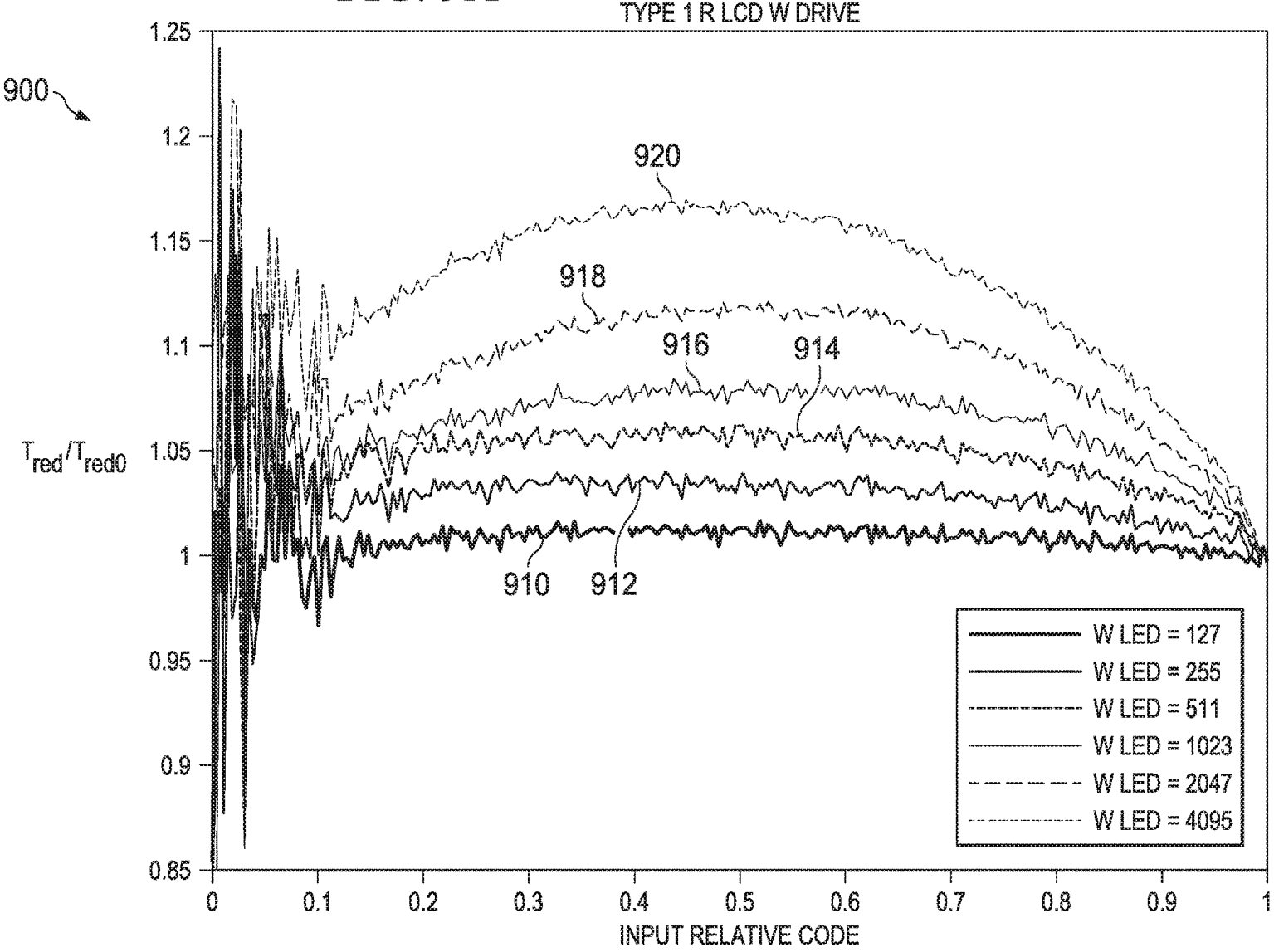
FIGS. 9A, 9B and 9C depict a differential transmittance of a type 1 LCD in accordance with an embodiment of the disclosure.
Figure 9B:
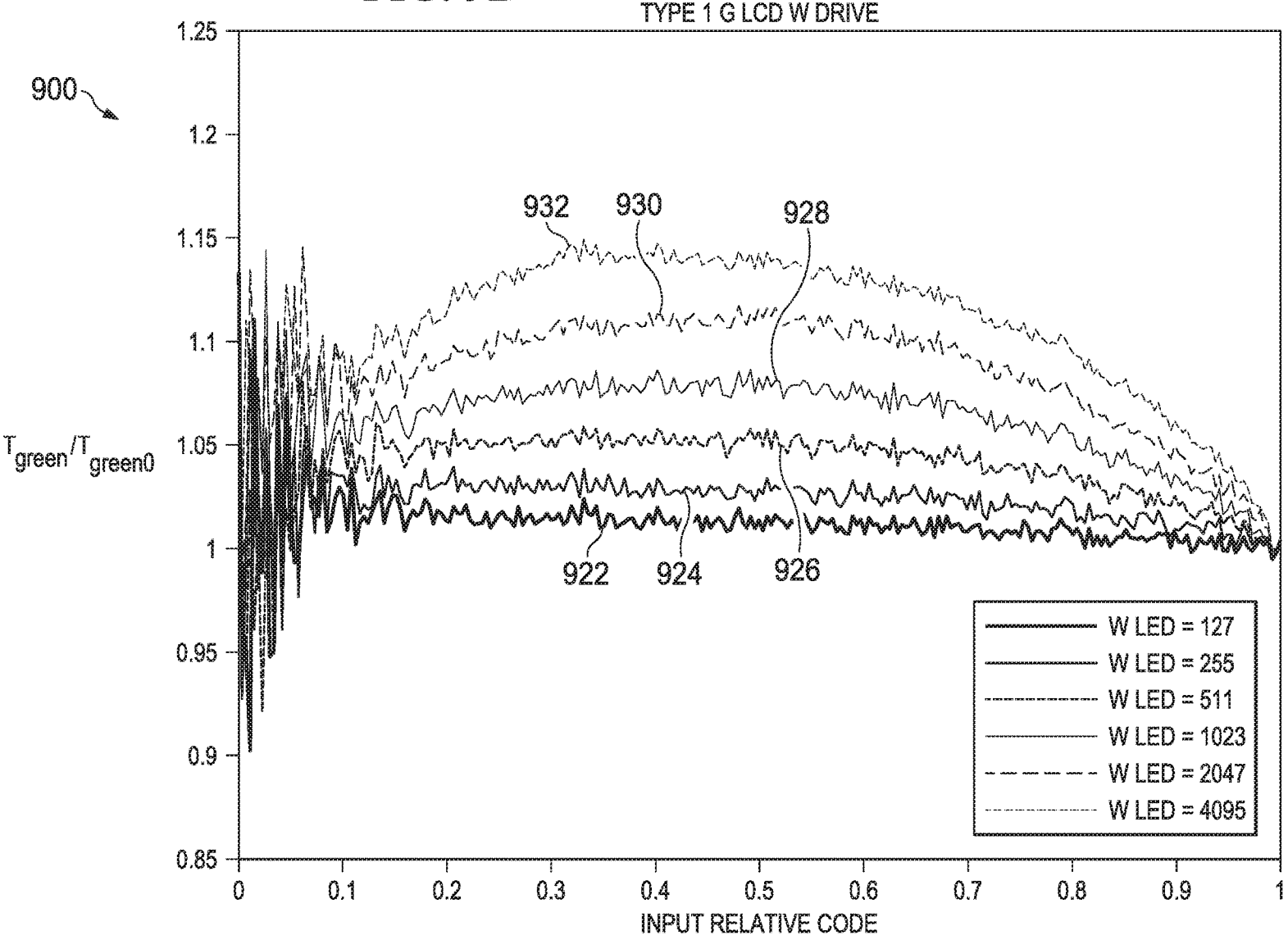
Figure 9C:
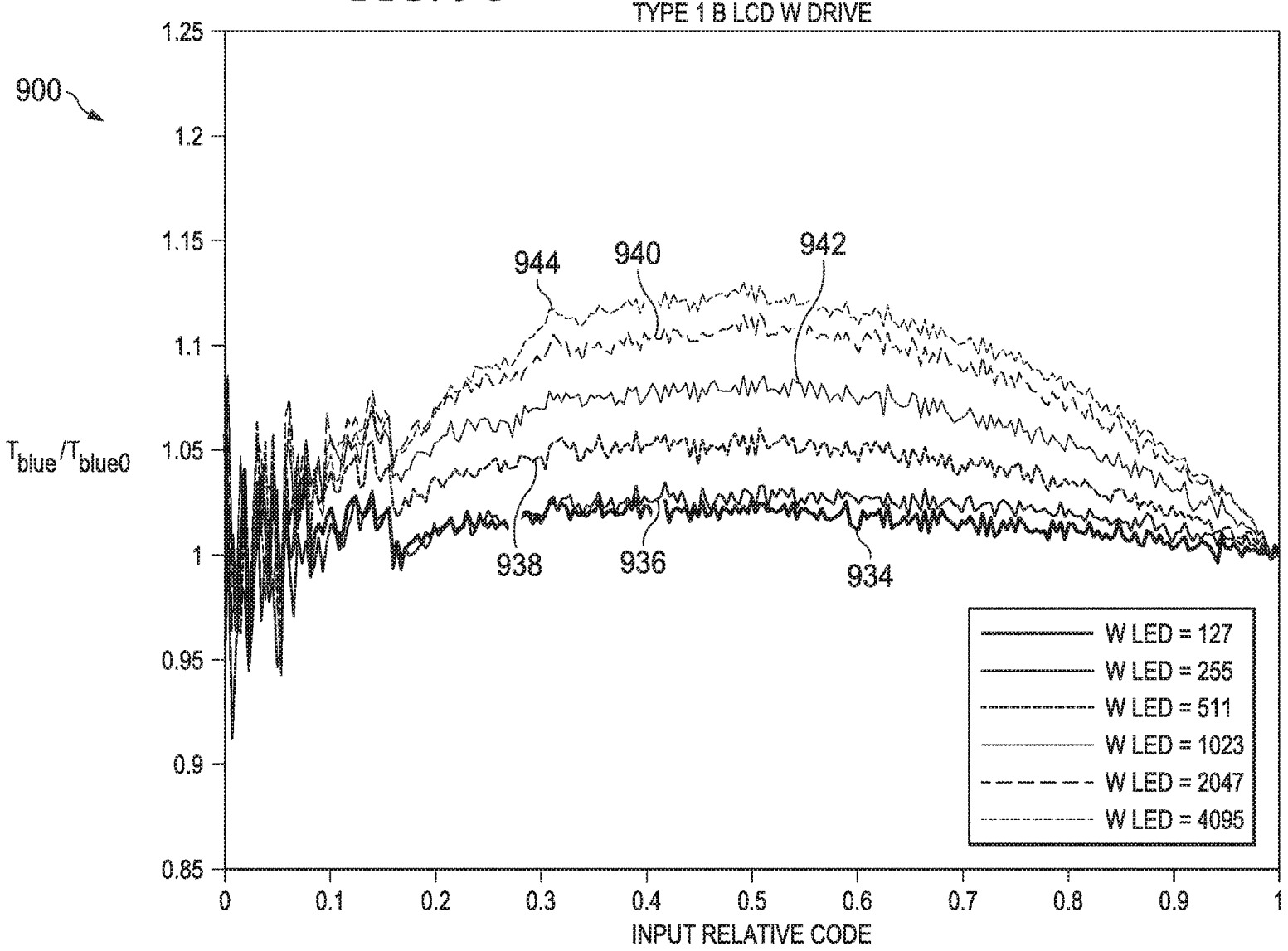
Figure 10A:
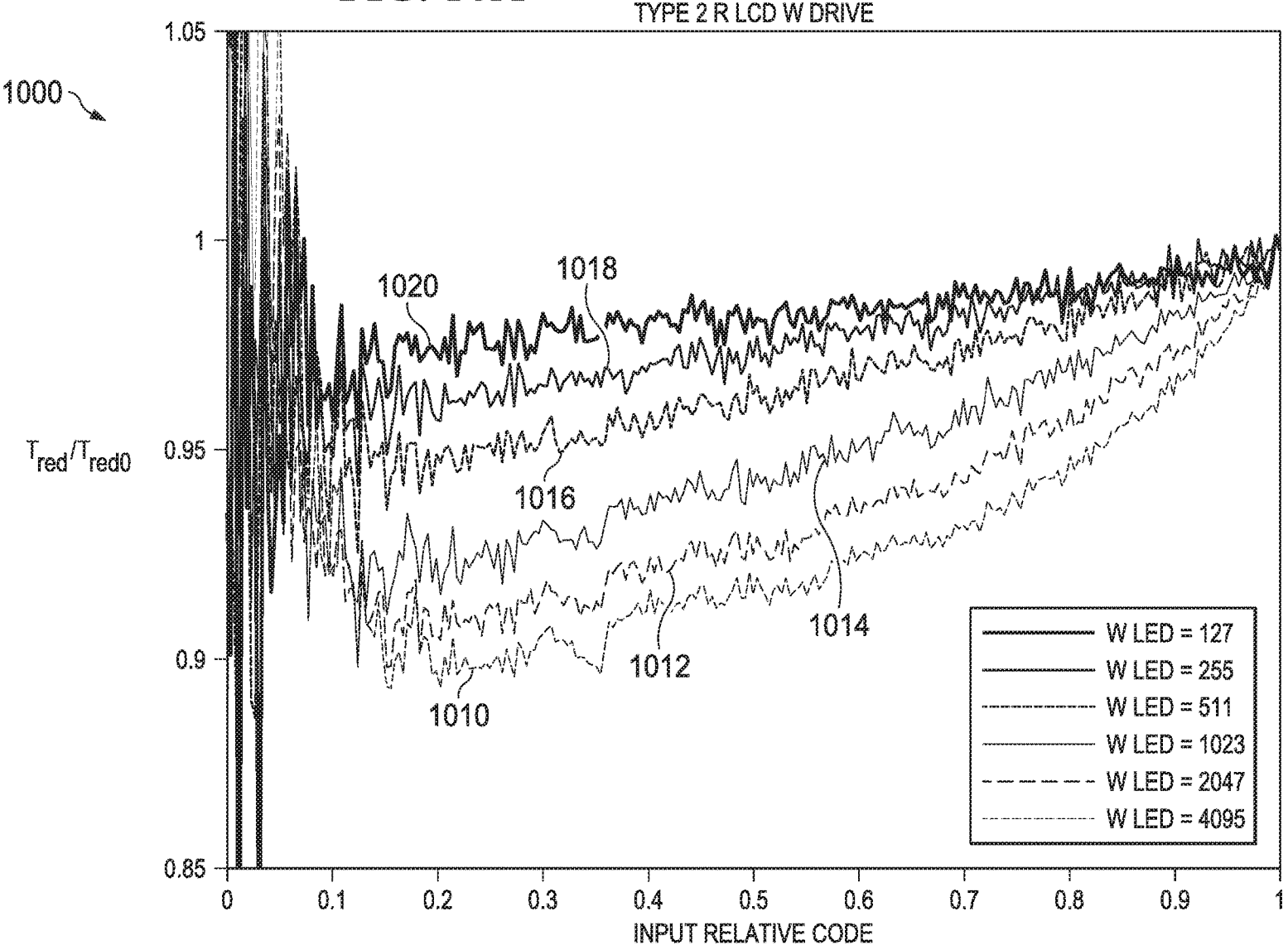
FIGS. 10A, 10B, and 10C depict a differential transmittance of a type 2 LCD in accordance with an embodiment of the disclosure.
Figure 10B:
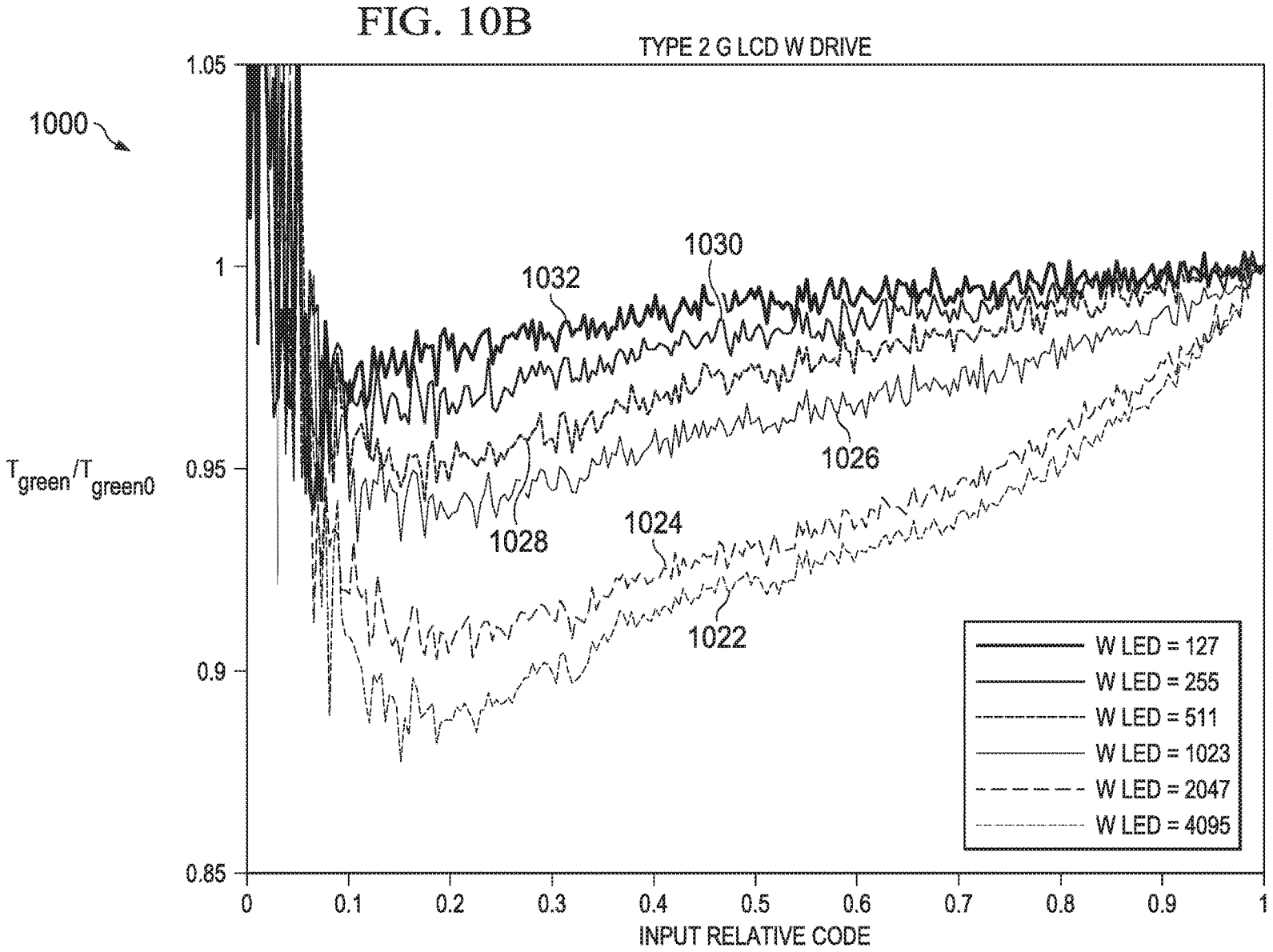
Figure 10C:
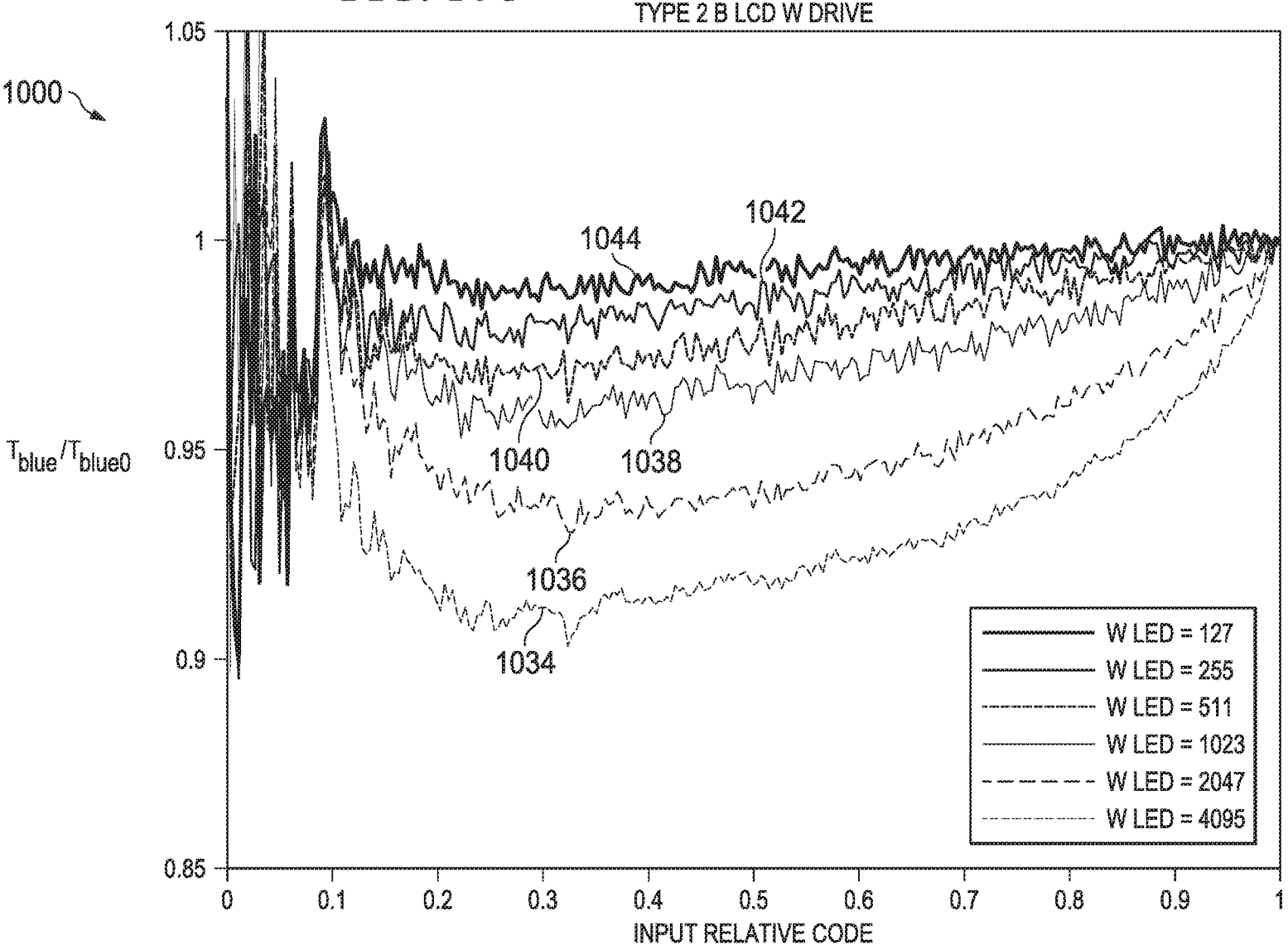

Plots of $F_{rel}^{i}(c_i, \vec{s})$ are shown in FIGS. 9-10, and indicate that the two panels show similar characteristics in this domain:

1) for channels of devices, a common envelope function is evident, whose value converges to 1 at the end points
2) the magnitude of the differential transmittance may be dependent on the backlight drive levels, such that the envelope shape remains relatively constant across this range.
3) For a type 1 LCD panel, the magnitude of the envelope increases monotonically with increasing backlight drive; for a type 2 LCD panel, the magnitude of this envelope decreases monotonically with increasing backlight drive.

Based on these observations, a separable model for the LCD response as a function of LCD code $c_i$ and backlight power vector $\vec{s}$ may be constructed:

$$T_i(c_i, \bar{s}) = T_o^i(c_i) F_{rel}^i(c_i, \bar{s}) \quad (1)$$

where $$F_{rel}^i(c_i, \bar{s}) = 1 + p_i q(\bar{s}) f_i(c_i) \quad (2)$$

In the above expression, $p_i$ is a strength coefficient for channel i, positive for a type 1 LCD panel, negative for type 2 LCD panel; $q(\bar{s}) \in [0,1]$ is a nonlinear "power" function, common across channels, describing the change in transmittance vs. backlight power; $f_i(c_i) \in [0,1]$ is the envelope function for channel i, such that $f_i(0) = f_i(1) = 0$.

FIG. 9 is the differential LCD response versus the relative code values for different LED drive levels for a type 1 LCD panel.

FIG. 9 for type 1 monitors, WLED at 127 input for red is 920, green is 932 and blue is 944, WLED at 255 input for red is 918, green is 930 and blue is 942, WLED at 511 input for red is 916, green is 928 and blue is 940, WLED at 1023 input for red is 914, green is 926 and blue is 938, WLED at 2047 input for red is 912, green is 924 and blue is 936 and WLED at 4095 input for red is 910, green is 922 and blue is 934.

FIG. 10 is the differential LCD response versus the relative code values for different LED drive levels for a type 2 LCD panel.

FIG. 10 for type 2 monitors, WLED at 127 input for red is 1020, green is 1032 and blue is 1044, WLED at 255 input for red is 1018, green is 1030 and blue is 1042, WLED at 511 input for red is 1016, green is 1028 and blue is 1040, WLED at 1023 input for red is 1014, green is 1026 and blue is 1038, WLED at 2047 input for red is 1012, green is 1024 and blue is 1036 and WLED at 4095 input for red is 1010, green is 1022 and blue is 1034.

Figure 11:
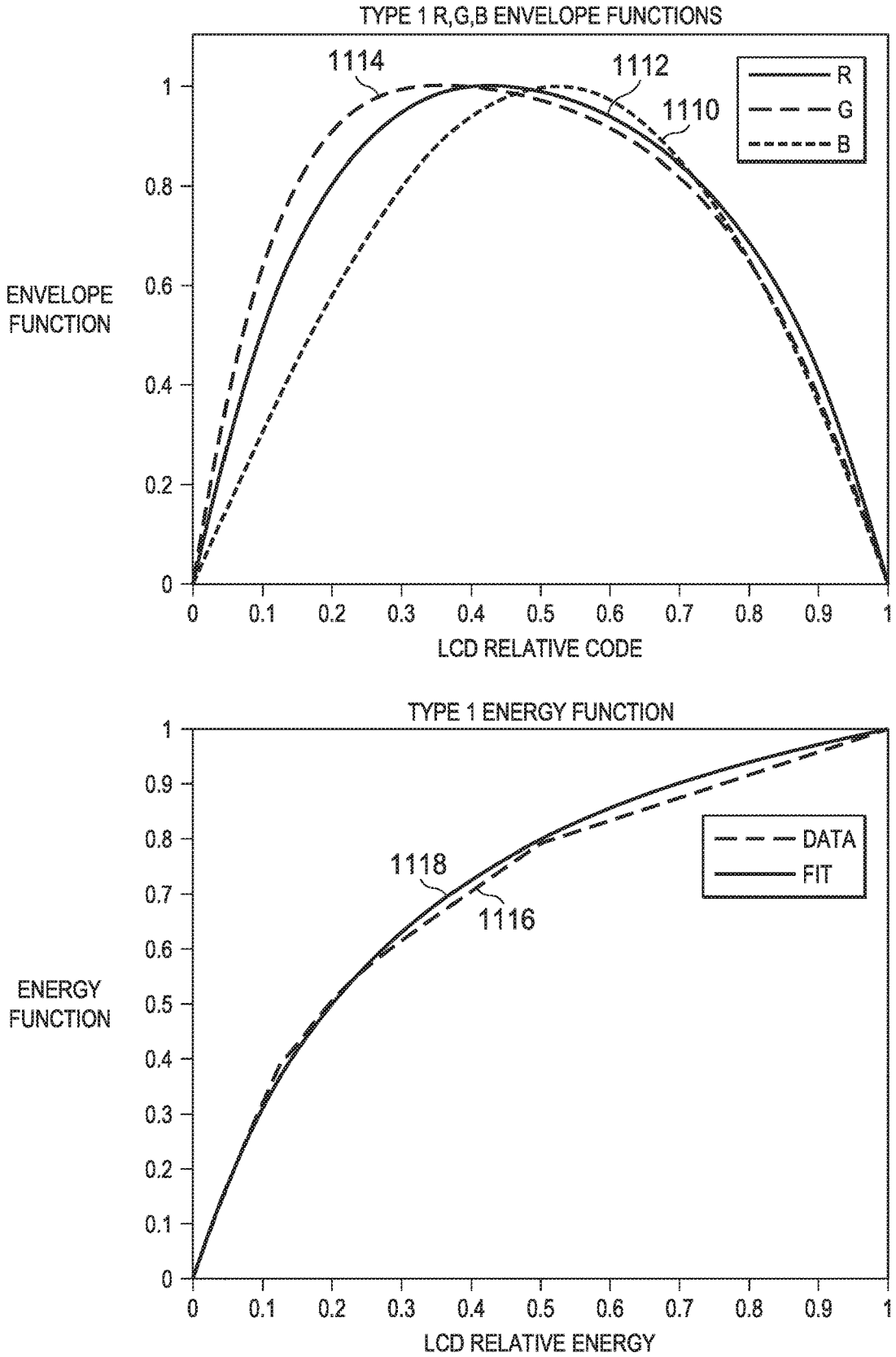
FIG. 11 depicts an envelope and power functions of a type 1 LCD in accordance with an embodiment of the disclosure.

For examples of the type 1 LCD panel FIG. 11 and type 2 LCD panels FIG. 12, the model parameters are summarized in the table below. Using these model components, the fit to the measured data from FIG. 8-9 is shown in FIG. 11 for type 1 LCD panels and FIG. 12 for type 2 LCD panels. This indicates that one model may be used to adequately describe the response of two LCD panel designs that have very different characteristics. This model may describe other LCD panels as well, provided a characterization is performed to determine the envelope and power functions, as well as the strength and backlight energy coefficients. This characterization may not be required per panel but instead may apply across a fleet as it describes the deviation of the gamma response relative to the low intensity measurement with respect to different backlight intensity levels.

FIG. 11 depicts type 1 envelope functions for red 1112, green 1114 and blue 1110 and on the right the energy function data is 1116 and the curve fit is 1118.

Figure 12:
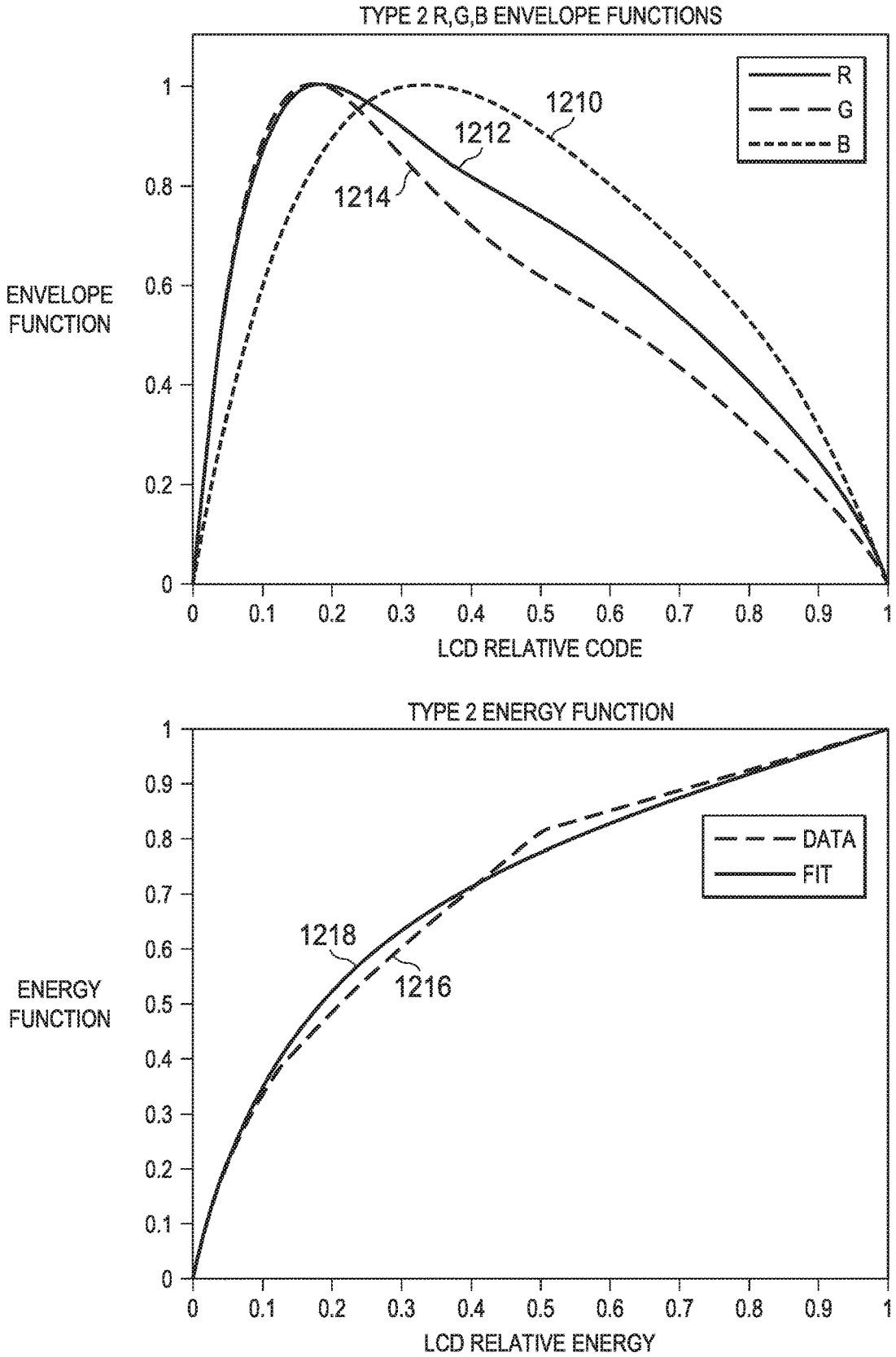
FIG. 12 depicts an envelope and power functions of a type 2 LCD in accordance with an embodiment of the disclosure.

FIG. 12 depicts type 2 envelope functions for red 1212, green 1214 and blue 1210 and on the right the energy function data is 1216 and the curve fit is 1218.

TABLE 1

LCD Model Parameters

| | Type 1 LCD | Type 2 LCD |
|---|---|---|
| Strength coefs, p: | $p_R = 0.1653$<br>$p_G = 0.1411$<br>$p_B = 0.1243$ | $p_R = -0.1085$<br>$p_G = -0.1196$<br>$p_B = -0.0933$ |
| backlight energy: | s = 0.33R + 0.33G + 0.33B | s = 0.42R + 0.33G + 0.25B |

Figure 13A:
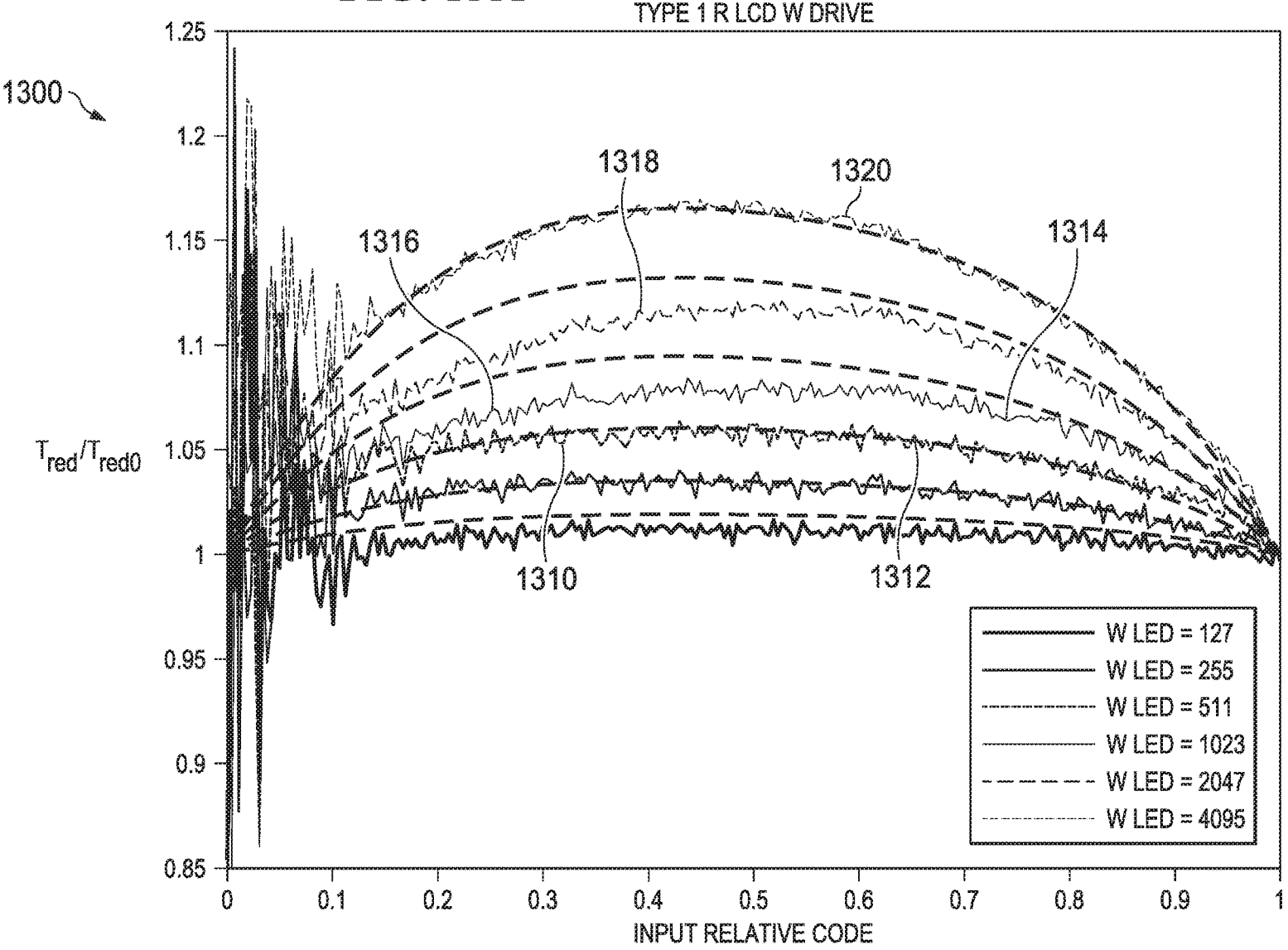
FIGS. 13A, 13B, and 13C depict a modelling result of a type 1 LCD in accordance with an embodiment of the disclosure.
Figure 13B:
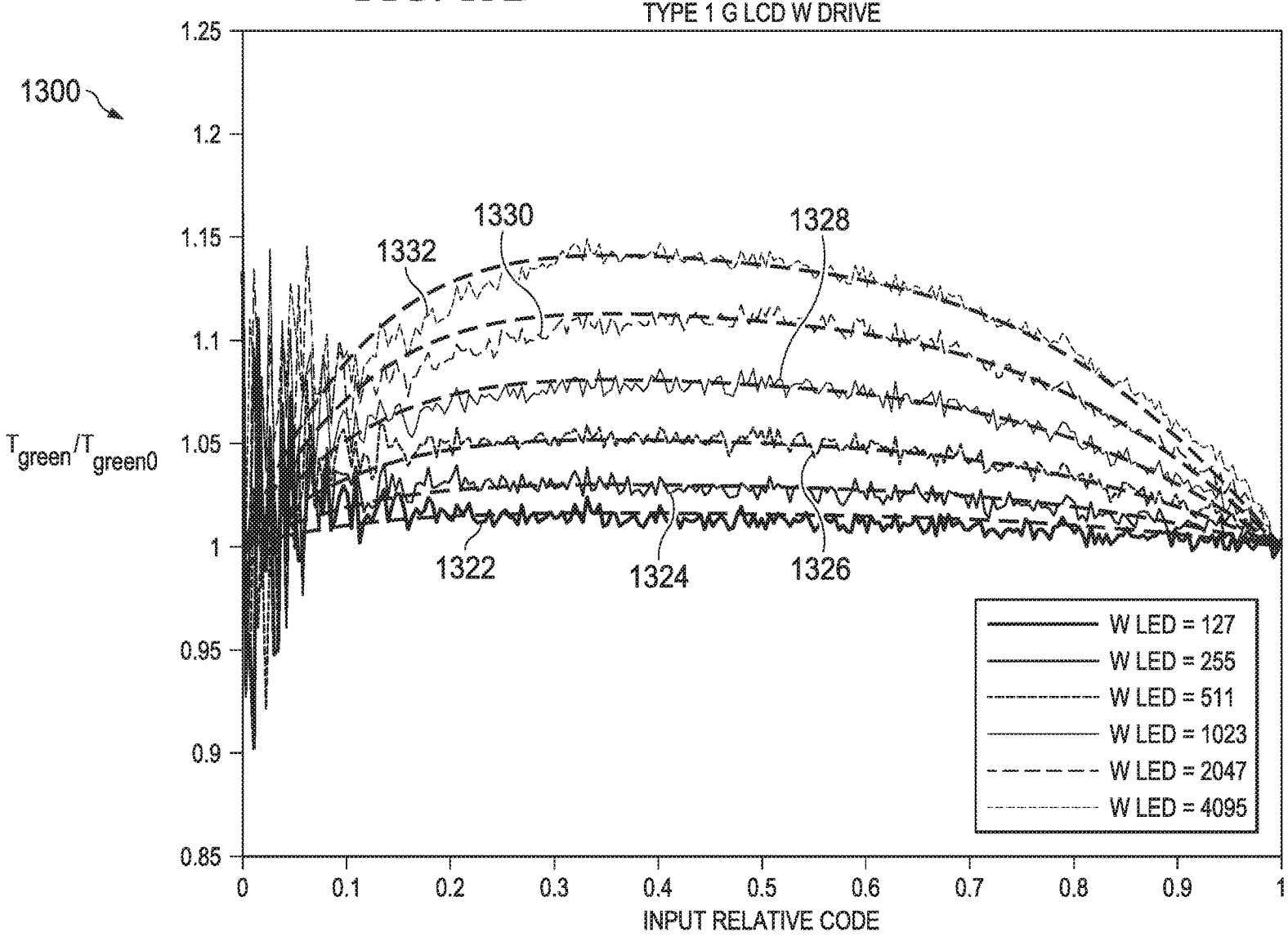
Figure 13C:
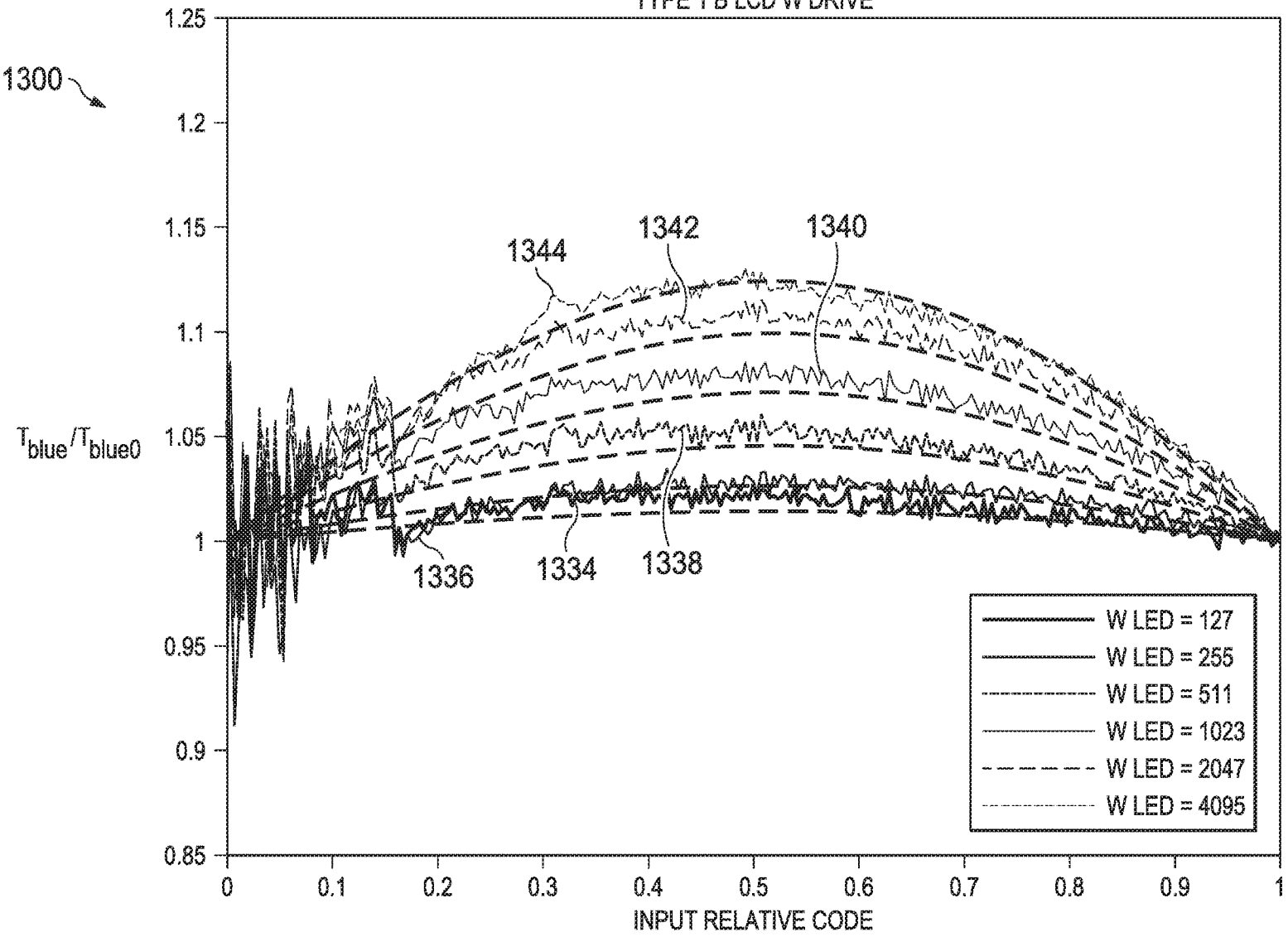
Figure 14A:
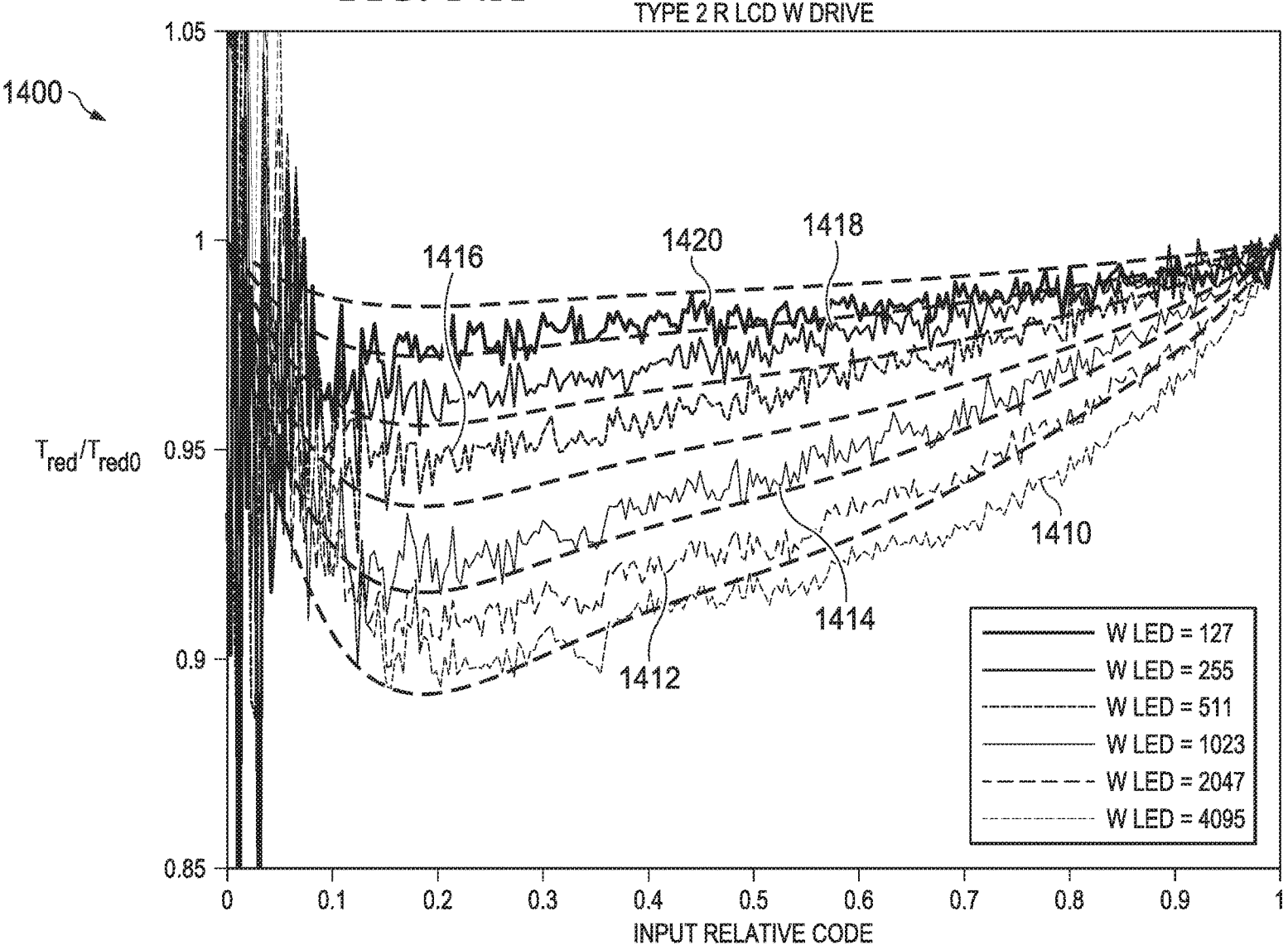
FIGS. 14A, 14B and 14C depict a modelling result of a type 2 LCD in accordance with an embodiment of the disclosure.
Figure 14B:
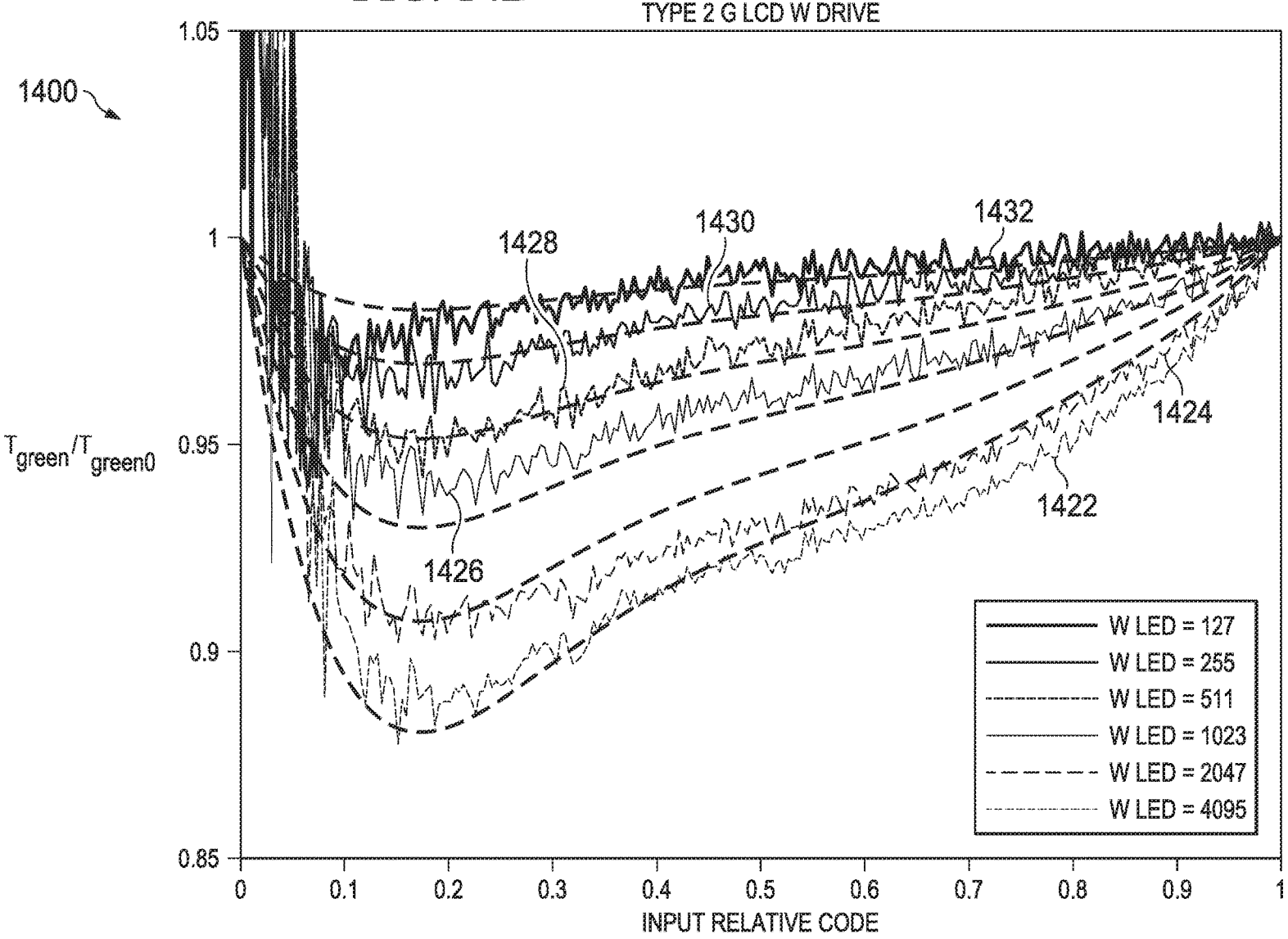
Figure 14C:
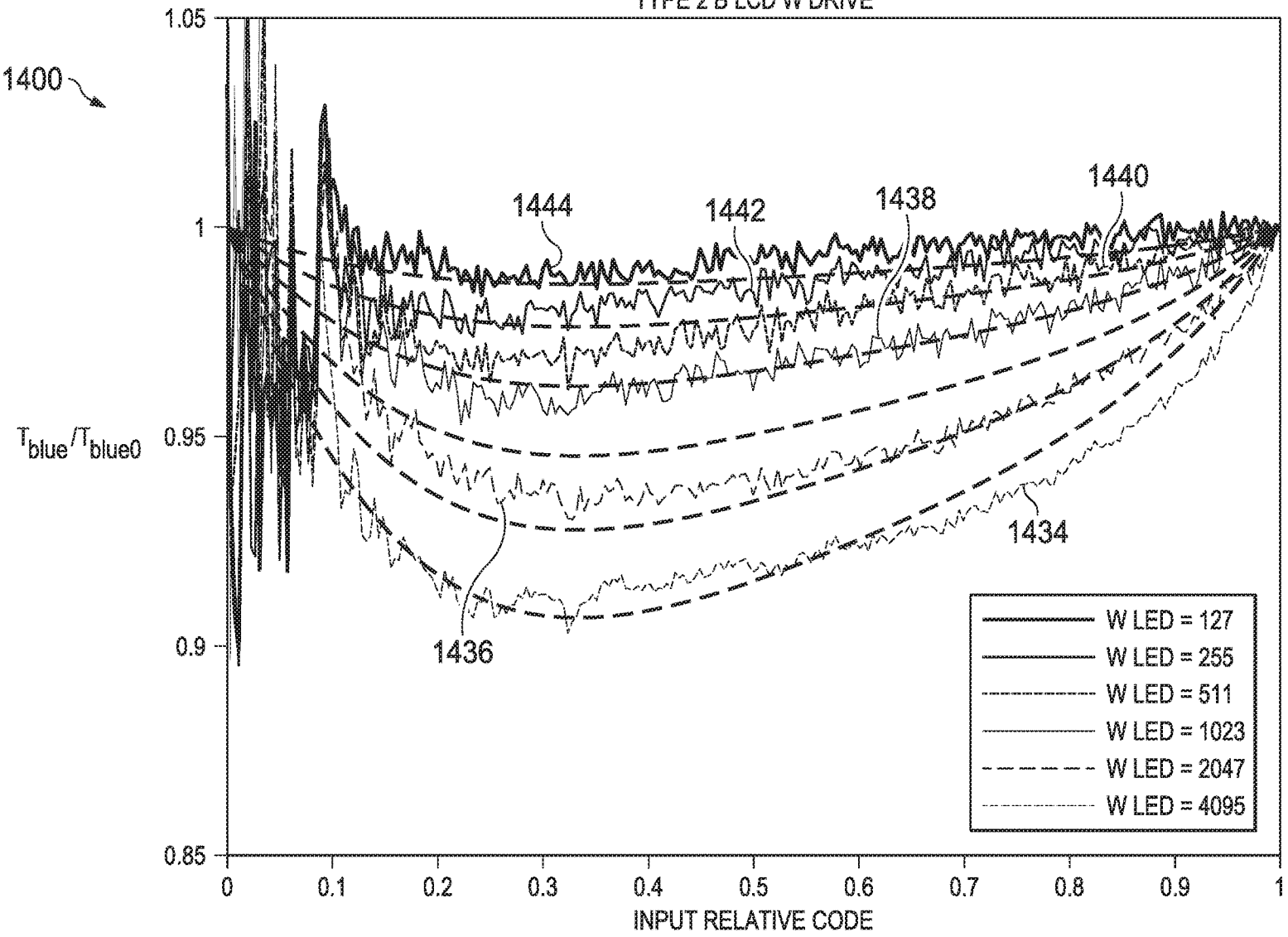

For the type 1 LCD panels FIG. 13 and type 2 LCD panels FIG. 14, the model parameters are summarized in the table above. Using these model components, the fit is to the measured data from the type 1 LCD panels FIG. 9 and type 2 LCD panels FIG. 10.

FIG. 13 for type 1 monitors, WLED at 127 input for red is 1320, green is 1332 and blue is 1344, WLED at 255 input for red is 1318, green is 1330 and blue is 1342, WLED at 511 input for red is 1316, green is 1328 and blue is 1340, WLED at 1023 input for red is 1314, green is 1326 and blue is 1338, WLED at 2047 input for red is 1312, green is 1324 and blue is 1336 and WLED at 4095 input for red is 1310, green is 1322 and blue is 1334.

FIG. 14 for type 2 monitors, WLED at 127 input for red is 1420, green is 1432 and blue is 1444, WLED at 255 input for red is 1418, green is 1430 and blue is 1442, WLED at 511 input for red is 1416, green is 1428 and blue is 1440, WLED at 1023 input for red is 1414, green is 1426 and blue is 1438, WLED at 2047 input for red is 1412, green is 1424 and blue is 1436 and WLED at 4095 input for red is 1410, green is 1422 and blue is 1434.

Equipped with a basic configurable model it is then possible to construct a correction algorithm. In this case, it is sought to achieve an LCD response mimicking that measured at low back light intensity levels, $T_0^i(c_i)$. In other words, at a particular backlight drive intensity, the LCD code words may be perturbed to compensate for the effects of the backlight power levels such that the target transmittance is achieved.

Given the previously derived transmittance model, $$T_i(c_i, \bar{s})=T_o^i(c_i)[1+p_i q(\bar{s}) f_i(c_i)] \tag{3}$$

Equation (3) may be inverted to find the change in LCD code value $\Delta c_i$ that may produce a transmittance equal to $T_o^i(c_i)$. A first-order Taylor expansion may be used estimate the perturbation $\Delta c_i$:

$$\Delta C_i \cong \frac{-T_i^o(c_i) p_i q(s) f_i(c_i)}{\frac{dT_o^i(c_i)}{dc_i}[1 + p_i q(s) f_i(c_i)] + p_i q(s) T_i^o(c_i) \frac{df_i(c_i)}{dc_i}}. \tag{4}$$

Equation (4) may be further approximated with the realization that $p_i q(s) f_i(c_i)$ is generally much smaller than unity, $$\Delta c_i \cong -q(s) L_i^0(c_i) + [q(s)]^2 L_i^1(c_i), \tag{5}$$

where:

$$L_i^0(c_i) \equiv \frac{p_i c_i f_i(c_i)}{\gamma} \tag{6}$$

$$L_i^1(c_i) \equiv \frac{p_i^2 c_i f_i^2(c_i)}{\gamma} + \frac{p_i^2 c_i^2 \ f_i(c_i)}{\gamma^2} \frac{df_i(c_i)}{dc_i}.$$

$L^0$ and $L^1$ are denoted first and second order correction functions, and may be represented as polynomial functions, or preferably as one dimensional look up tables (1D LUT). These correction functions are dependent on one variable, the LCD relative code value $c_i$.

Figure 15:
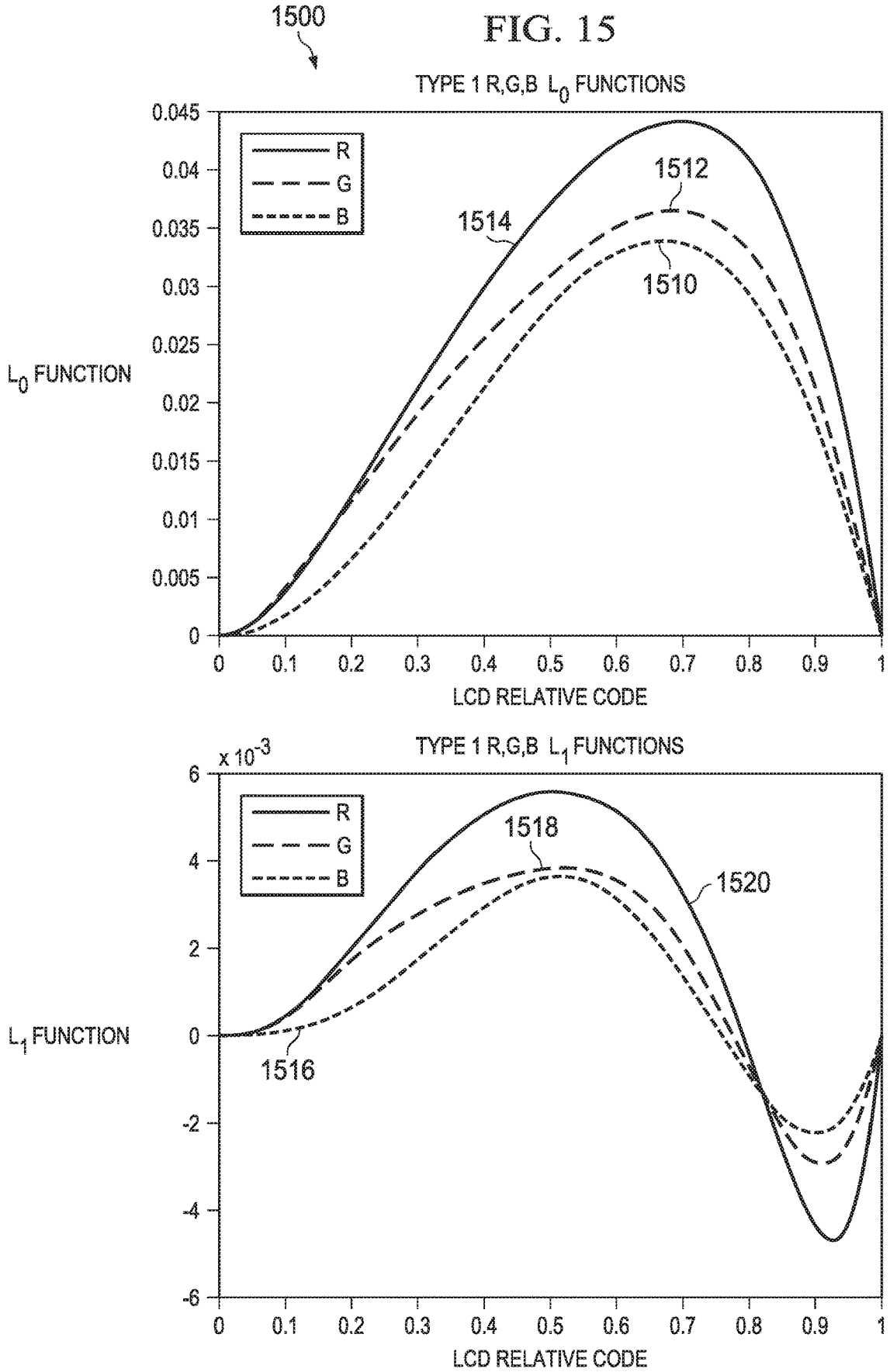
FIG. 15 depicts example compensation functional forms for L0 and L1 of a type 1 LCD in accordance with an embodiment of the disclosure.
Figure 16:
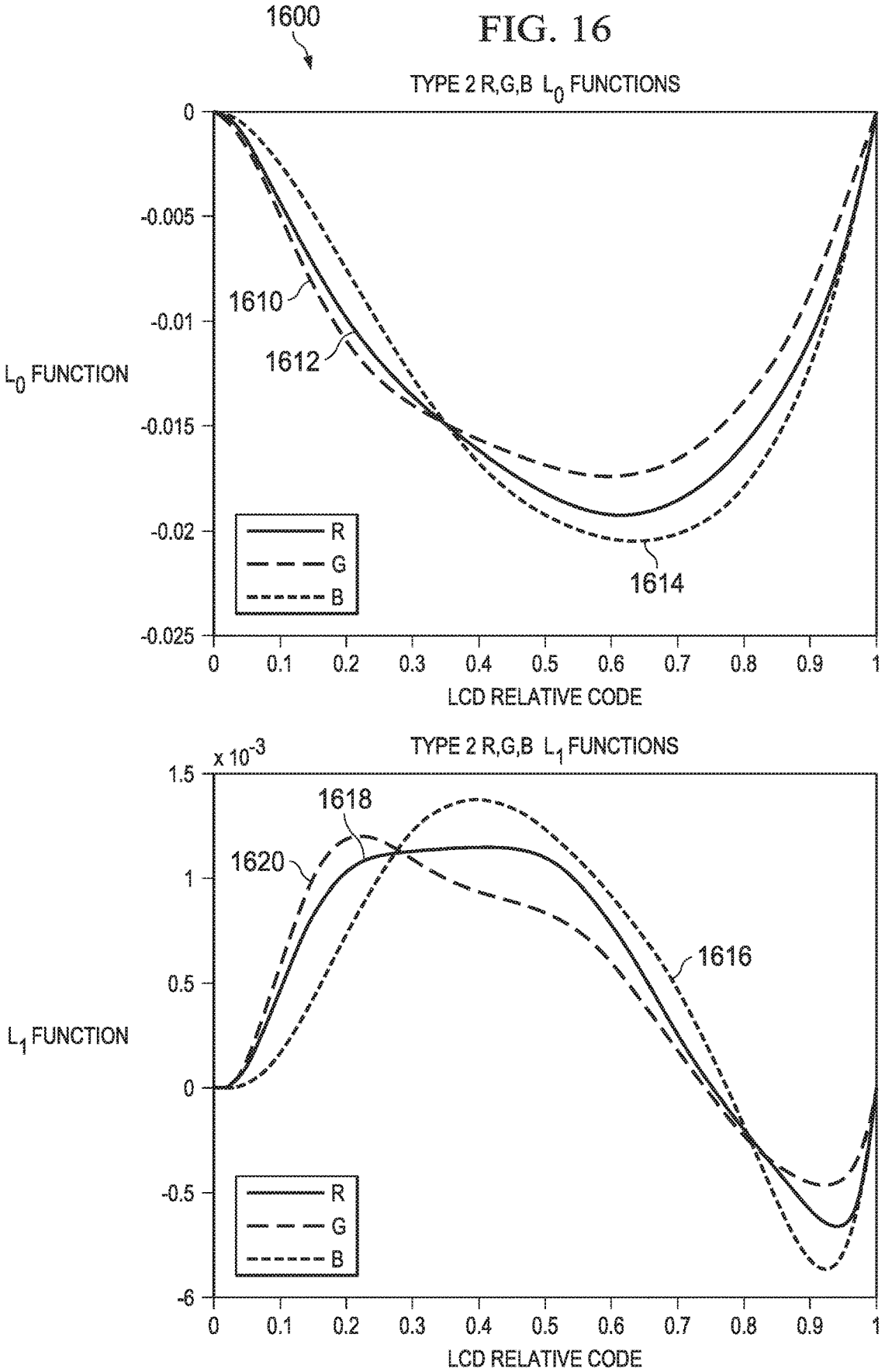
FIG. 16 depicts example compensation algorithm functional forms for L0 and L1 of a type 2 LCD in accordance with an embodiment of the disclosure.

FIGS. 15 and 16 show examples of the correction functions for the type 1 LCD panels and type 2 LCD panels respectively. The first order correction functions show opposite polarity for the type 1 and type 2 LCD panels. The second order correction functions are generally much smaller in magnitude relative to $L^0$, the relative strength becomes greater near relative code=0.9.

FIG. 15 depicts correction functions $L^0$ 1510 and $L^1$ 1512 for type 1 LCD panels. Red is designated by 1514 and 1520, green is designated by 1512 and 1518 and blue is designated by 1510 and 1516.

FIG. 16 depicts correction functions $L^0$ 1610 and $L^1$ 1612 for type 2 LCD panels. Red is designated by 1612 and 1618, green is designated by 1610 and 1620 and blue is designated by 1614 and 1616.

Equipped the model and its subsequent inversion, it is now possible to construct the steps for LCD compensation for LCD pixel sites:

1) Estimate the R, G, and B backlight optical power levels based on the light field simulation (LFS) associated with the individual backlight drives, such as a tristimulus XYZ value corresponding to the LCD channel Summing these three produces one tristimulus set $XYZ_{LFS}$ which may be used to estimate the relative R,G,B backlight power levels, $S_i \in [0,1]$, $$\begin{bmatrix} R \\ G \\ B \end{bmatrix}_{LED} = N \begin{bmatrix} X \\ Y \\ Z \end{bmatrix}_{LFS},$$

where N is a 3×3 matrix.

2) Determine the backlight power $s=\beta_R R_{LED}+\beta_G G_{LED}+\beta_B B_{LED}$, where $\beta_i$ correspond to the backlight energy coefficients 3) Determine the value of the power function q(s), usually a low order polynomial or a (real-valued) Laurent series.

4) Determine the initial LCD code value $c_i^o$ by inverting $T_i^o(c_i^o)$—note that this step may already be performed in a dual-modulation pipeline without the LCD compensation, it has been included here for completeness.

5) Determine the $L_0$ and $L_1$ values from $C_i^o$. This may be performed via a polynomial, or preferably using an m-bit 1D lookup table, where m may be 16.

6) Determine the corrected LCD code value:

$$c_i=c_i^o-qL_o+q^2L_1 \tag{7}$$

Note that for some LCD panels, utilizing only a first order correction term ($L_0$) may be sufficient and thus would reduce the overall computation.

LCD Emulation

In certain cases, it may be desirable to emulate the behavior of a particular LCD model's response. For example, if content has been mastered on monitors using type 1 LCD panels without LCD compensation, it may be required to have the content appear visually equivalent on monitors constructed using type 2 LCD panels. Colorists and other creatives may not wish to apply a trim based on which LCD panel is used. The same algorithm described in equation (7) may be used to cause one LCD panel to emulate the lightfield-dependent behavior of another, for example, emulating the differential response of the type 1 LCD panel on a type 2 LCD panel.

In this case, the target transmittance may be that of the destination device. The code value correction may become:

$$\Delta c_i \cong -q(s)L_{0i}^{e}(c_i) + [q(s)]^2 L_{1i}^{e}(c_i), \tag{8}$$

where:

$$L_{0i}^{e}(c_i) \equiv \frac{p_i c_i f_i(c_i)}{\gamma} - \frac{p_i^d c_i f_i^d(c_i)}{\gamma} \tag{9}$$

$$L_{1i}^{e}(c_i) \equiv \frac{p_i^2 c_i f_i^2(c_i)}{\gamma} + \frac{p_i^2 c_i^2 \ f_i(c_i)}{\gamma^2}\frac{df_i(c_i)}{dc_i} - \frac{p_i^d p_i c_i f_i^d(c_i) f_i(c_i)}{\gamma} - \frac{p_i^d p_i c_i^2 \ f_i^d(c_i)}{\gamma^2}\frac{df_i(c_i)}{dc_i}.$$

Figure 17:
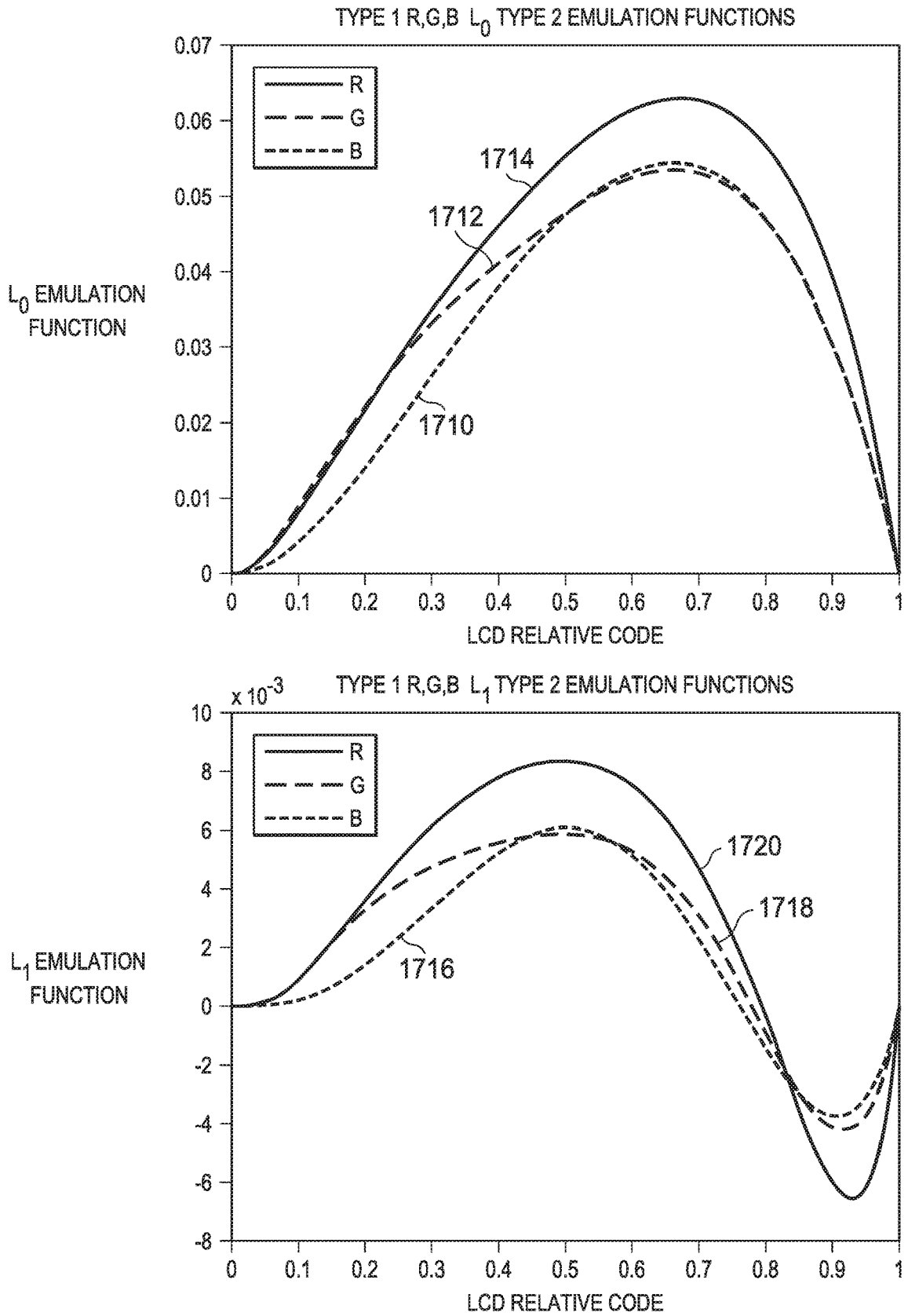
FIG. 17 depicts L0 and L1 emulation functions of a type 1 to type 2 LCD in accordance with an embodiment of the disclosure.
Figure 18:
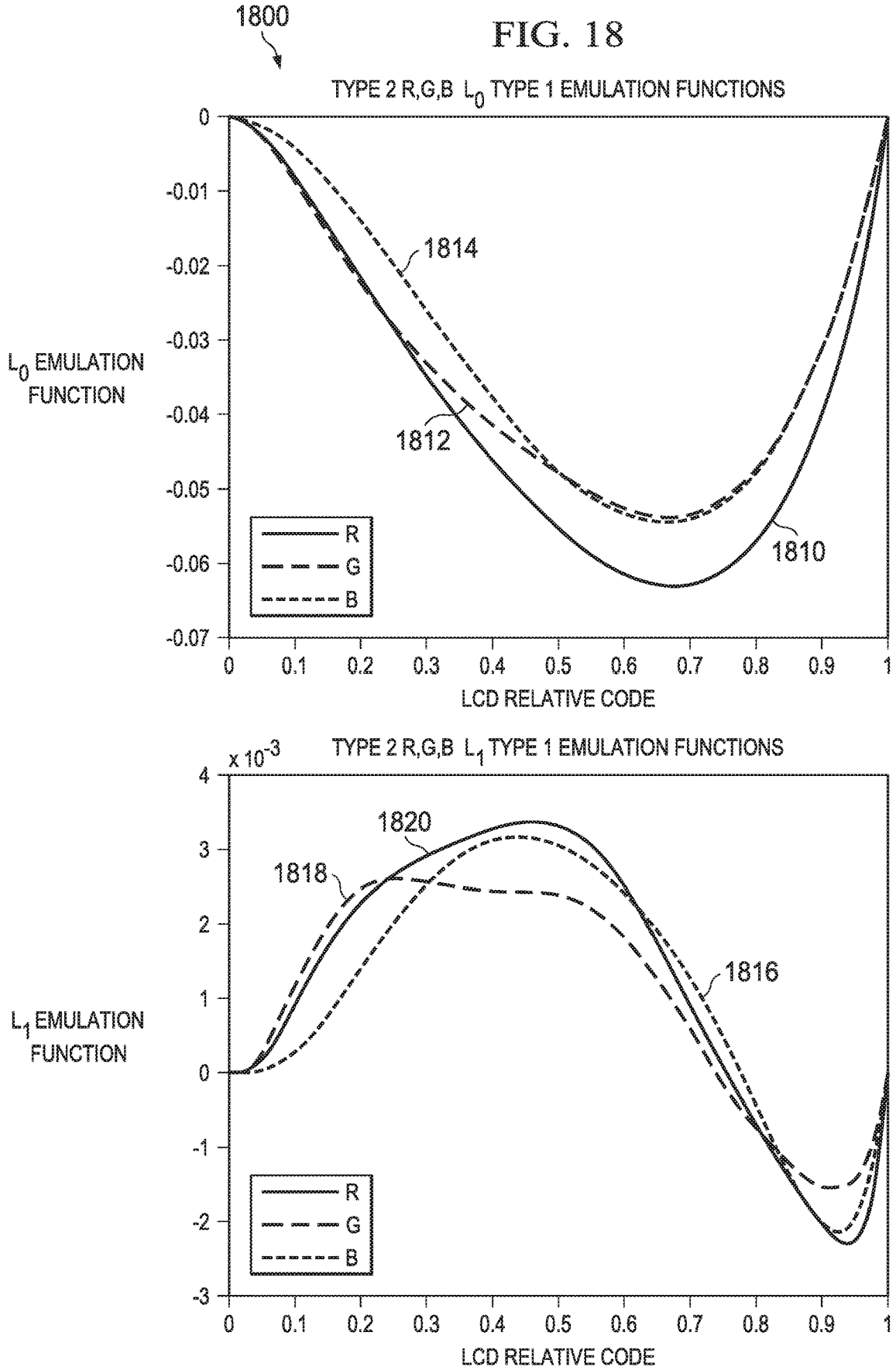
FIG. 18 depicts L0 and L1 emulation functions of a type 2 to type 1 LCD in accordance with an embodiment of the disclosure.

In equations (8) and (9), the "d" superscript refers to the destination LCD panel. The first and second order emulation functions for type 1 LCD panel emulation of type 2 LCD panels and vice-versa are shown in FIGS. 17-18 respectively. In this example, the magnitude of these functions is greater than those shown in FIGS. 15-16, as the emulation will cause the panel, type 2 LCD panel, to a response beyond correction to approximate the behavior of the target LCD, type 1 LCD panel. Thus it may be possible to emulate the properties of a target LCD panel using the same algorithm as described for correction, except for the use of different $L_0$ and $L_1$ functions.

With these algorithms in place, it may be possible to achieve a visual match when using two monitors with different LCD panel models, type 1 and type 2. The algorithm itself is efficient, and imposes a 1-2% increase in processing time for the pipeline. It is expected this algorithm may be applied to a variety of other LCD panels with similar results.

FIG. 17 Emulation functions $L^0$ 1710 and $L^1$ 1712 for type 1 LCD panels emulating type 2 LCD panels. Red is designated by 1714 and 1720, green is designated by 1712 and 1718 and blue is designated by 1710 and 1716.

FIG. 18 Emulation functions $L^0$ 1810 and $L^1$ 1812 for type 2 LCD panels emulating type 1 LCD panels. Red is designated by 1810 and 1820, green is designated by 1812 and 1818 and blue is designated by 1814 and 1816.

FIG. 19 depicts a method for compensation of liquid crystal display response variations in high brightness fields, comprising receiving 1910 an image signal having a set of initial liquid crystal display code values for a region, estimating 1912 individual backlight power levels for the region of the image signal, determining 1914 a combined backlight power level based on the individual backlight power levels of the region, determining 1916 at least one change in transmittance based on the combined backlight power level of the region, and correcting 1918 the set of initial liquid crystal display code values based in the determined at least one change in transmittance.

FIG. 20 depicts a method for compensation of liquid crystal display response variations in high brightness fields, comprising receiving 2010 an image signal having a set of initial liquid crystal display code values for a region, estimating 2012 individual backlight power levels for the region, determining 2014 a combined backlight power level based on the individual backlight power levels of the region, determining 2016 at least one delta change in transmittance based on the combined backlight power level of the region and a reference power level, correcting 2018 the set of initial liquid crystal display code values based in the determined at least one delta change in transmittance.

FIG. 21 depicts a method for compensation of liquid crystal display response variations in high brightness fields, comprising receiving 2110 an image signal, estimating 2112 a plurality of colors for a region of the image signal, estimating 2114 a plurality of backlight power levels for the region, measuring 2116 the transmittance for the plurality of colors and the plurality of backlight power levels, modelling 2118 the measured transmittance.

Figure 22:
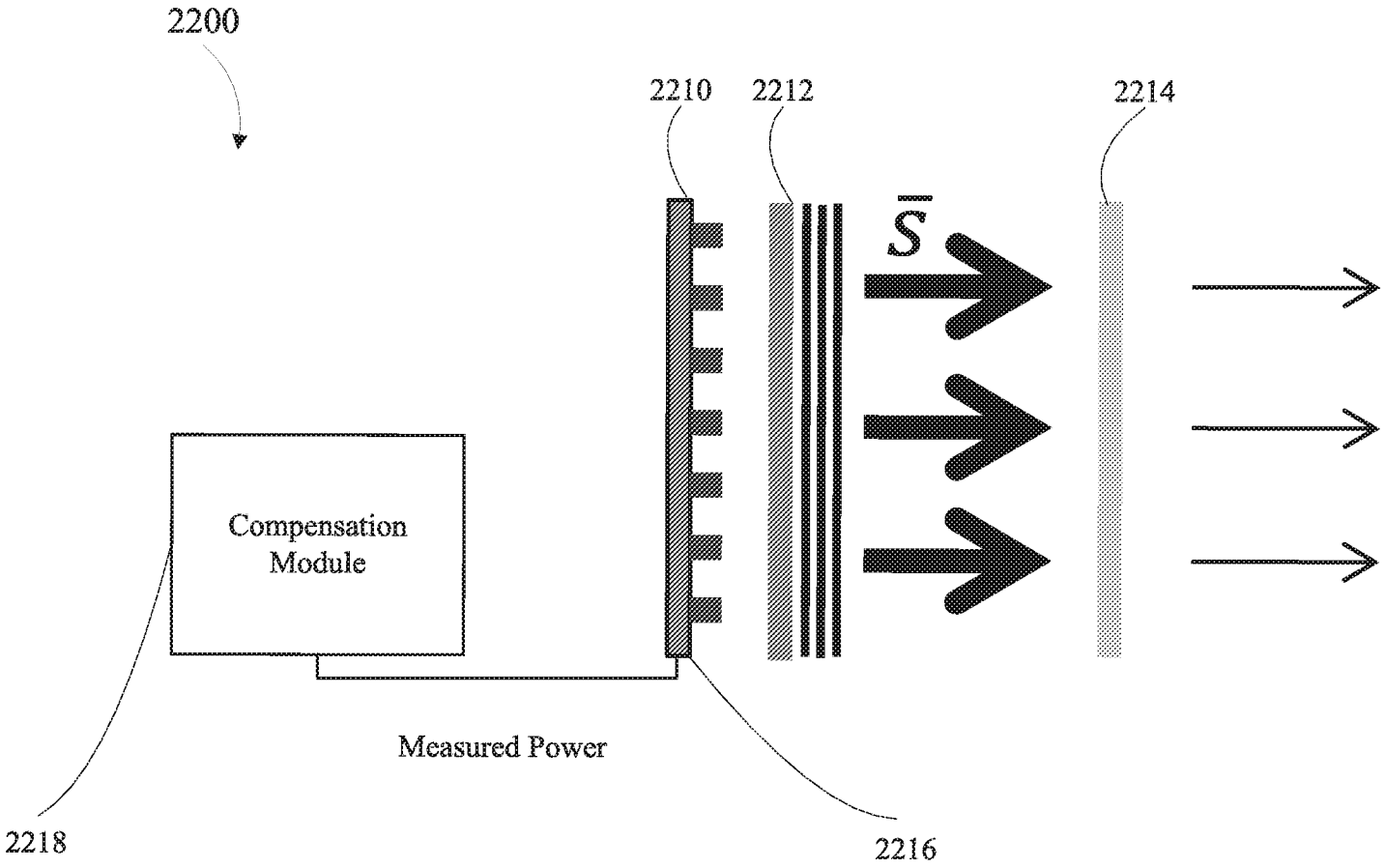
FIG. 22 depicts a second system in accordance with an embodiment of the disclosure.

FIG. 22 depicts an apparatus that compensates for liquid crystal display response variations in high brightness fields, comprising a power measurement device 2216 coupled to a local backlight array 2210 of the liquid crystal display, a compensation module 2218 coupled to the power measurement device and the liquid crystal display, wherein the compensation module, modulates a set of initial liquid crystal display code values based on a measured power.

Figure 23:
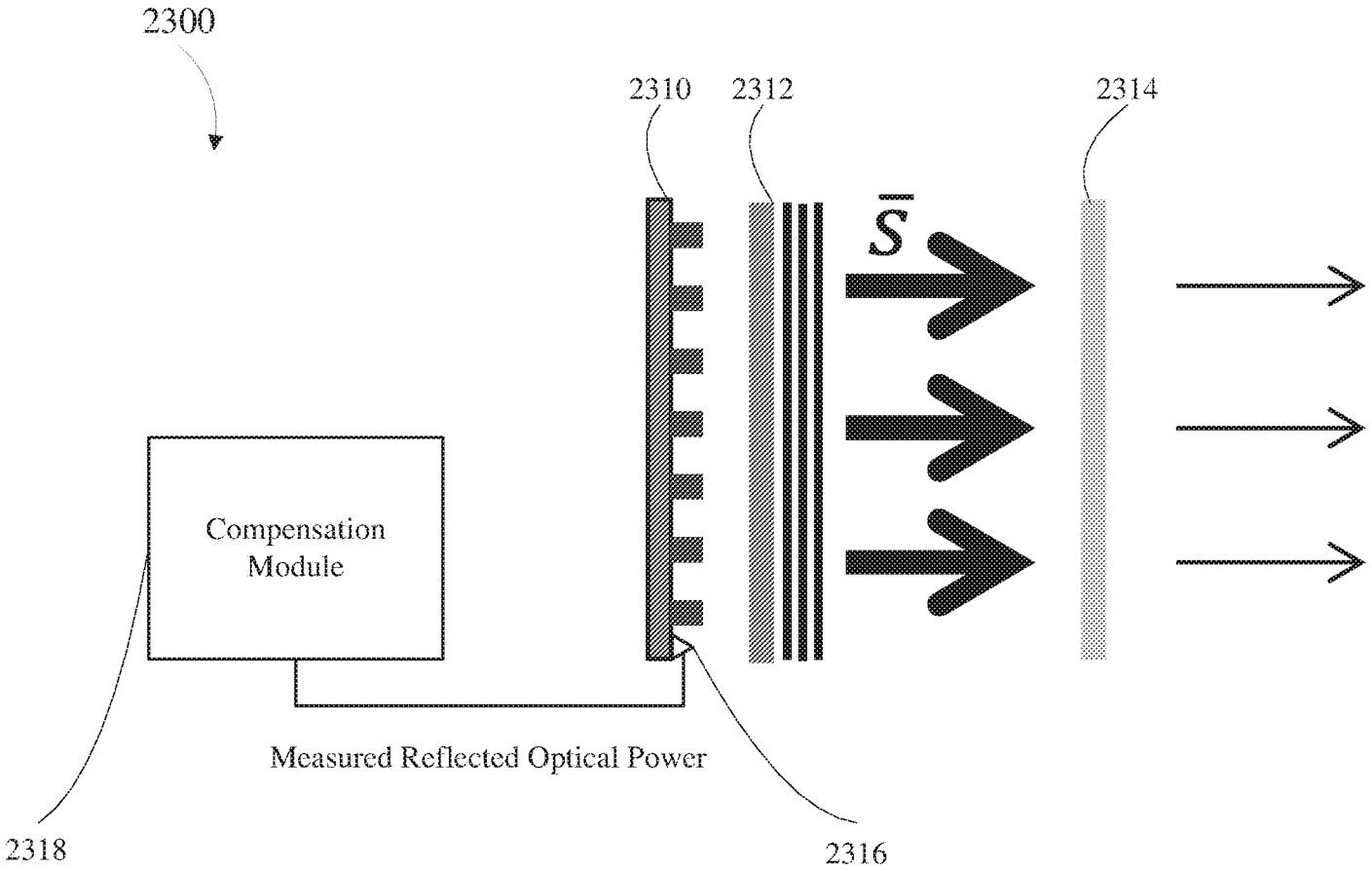
FIG. 23 depicts a third system in accordance with an embodiment of the disclosure.

FIG. 23 depicts an apparatus that compensates for liquid crystal display response variations in high brightness fields, comprising a reflected optical power measurement device 2316 coupled to a local backlight array 2310 of the liquid crystal display, a compensation module 2318 coupled to the reflected optical power measurement device and the liquid crystal display, wherein the compensation module, modulates a set of initial liquid crystal display code values based on a reflected optical power.

The method described in the present disclosure may be implemented in hardware, software, firmware or any combination thereof. Features described as blocks, modules or components may be implemented together (e.g., in a logic device such as an integrated logic device) or separately (e.g., as separate connected logic devices). The software portion of the methods of the present disclosure may comprise a computer-readable medium which comprises instructions that, when executed, perform, at least in part, the described methods. The computer-readable medium may comprise, for example, a random access memory (RAM) and/or a read-only memory (ROM). The instructions may be executed by a processor (e.g., a digital signal processor (DSP), an application specific integrated circuit (ASIC), a field programmable logic array (FPGA), a graphic processing unit (GPU) or a general purpose GPU).

Equivalents, Extensions, Alternatives and Miscellaneous

Example embodiments that relate to LCD gamma compensation based on brightness are thus described. In the foregoing specification, embodiments of the present disclosure have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

Various aspects of the present invention may be appreciated from the following enumerated example embodiments (EEEs).

EEE 1. A method for compensation of liquid crystal display response variations in high brightness fields with a processor, the method comprising:

receiving an image signal having a set of initial liquid crystal display code values for a region;

estimating individual backlight power levels for the region of the image signal;

determining a combined backlight power level based on the individual backlight power levels of the region;

determining at least one change in transmittance based on the combined backlight power level of the region; and correcting the set of initial liquid crystal display code values based in the determined at least one change in transmittance.

EEE 2. The method of EEE 1 wherein the estimating individual backlight power levels of the region is based on a light field simulation.

EEE 3. The method of EEE 1 or EEE 2 wherein the estimating individual backlight power levels of the region is a three by three matrix for red, blue and green.

EEE 4. The method of any preceding EEE wherein the combined backlight power level is for red, blue and green.

EEE 5. The method of any preceding EEE wherein the at least one change in transmittance is an inversion of a measured transmittance at a reference power setting.

EEE 6. The method of any preceding EEE wherein the set of initial liquid crystal display code values is based on a look up table.

EEE 7. The method of any preceding EEE further comprising quantizing the corrected set of initial liquid crystal display codes.

EEE 8. The method of any preceding EEE wherein the determining at least one change in transmittance is based on a polynomial.

EEE 9. A method for compensation of liquid crystal display response variations in high brightness fields with a processor, the method comprising:

receiving an image signal having a set of initial liquid crystal display code values for a region;

estimating individual backlight power levels for the region;

determining a combined backlight power level based on the individual backlight power levels of the region;

determining at least one delta change in transmittance based on the combined backlight power level of the region and a reference; and correcting the set of initial liquid crystal display code values based in the determined at least one delta change in transmittance.

EEE 10. The method of EEE 9 wherein the estimating individual backlight power levels of the region is based on a light field simulation.

EEE 11. The method of EEE 9 or EEE 10 wherein the estimating individual backlight power levels of the region is a three by three matrix for red, blue and green.

EEE 12. The method of any one of EEEs 9 to 11 wherein the combined backlight power level is for red, blue and green.

EEE 13. The method of any one of EEEs 9 to 12 wherein the at least one change in transmittance is an inversion of a measured transmittance at a reference power setting.

EEE 14. The method of any one of EEEs 9 to 13 wherein the set of initial liquid crystal display code values is based on a look up table.

EEE 15. The method of any one of EEEs 9 to 14 further comprising quantizing the corrected set of initial liquid crystal display codes.

EEE 16. The method of any one of EEEs 9 to 15 wherein the determining at least one change in transmittance is based on a polynomial.

EEE 17. A method for compensation of liquid crystal display response variations in high brightness fields with a processor, the method comprising:

receiving an image signal;

estimating a plurality of colors for a region of the image signal;

estimating a plurality of backlight power levels for the region;

measuring a transmittance for the plurality of colors and the plurality of backlight power levels; and modelling the measured transmittance.

EEE 18. The method of EEE 17 further comprising creating a look up table based on the modelled transmittance.

EEE 19. The method of EEE 17 or EEE 18 further comprising creating an inverse look up table based on the modelled transmittance.

EEE 20. An apparatus that compensates for liquid crystal display response variations in high brightness fields, comprising:

a power measurement device coupled to a local backlight array of the liquid crystal display;

a compensation module coupled to said power measurement device and said liquid crystal display; and wherein said compensation module, modulates a set of initial liquid crystal display code values based on a measured power.

EEE 21. The apparatus of EEE 20 wherein the compensation module estimates at least one change in transmittance based on the measured power.

EEE 22. An apparatus that compensates for liquid crystal display response variations in high brightness fields, comprising:

a reflected optical power measurement device coupled to a local backlight array of the liquid crystal display;

a compensation module coupled to said reflected optical power measurement device and said liquid crystal display; and wherein said compensation module, modulates a set of initial liquid crystal display code values based on a reflected optical power.

EEE 23. The apparatus of EEE 22 wherein the compensation module estimates at least one change in transmittance based on the measured reflected optical power.

The invention claimed is:

1. In a display comprising an LCD modulator and a backlight, a method of controlling the LCD modulator, the method comprising:

receiving an image signal comprising an LCD code value for setting a transmittance level of at least a part of the LCD modulator, wherein the received LCD code value corresponds to a target transmittance level on a first response curve giving transmittance levels as a function of LCD code values for said at least a part of the LCD modulator when illuminated by at least a part of the backlight at a reference output level thereof;

obtaining an output level value of said at least a part of the backlight;

determining an adapted LCD code value as a function of the received LCD code value and the obtained output level value, such that the adapted LCD code value corresponds to the target transmittance level on a second response curve giving transmittance levels as a function of LCD code values for said at least a part of the LCD modulator when illuminated by said at least a part of the backlight at the obtained output level value, the output level value being different from the reference output level such that the second response curve is different from the first response curve; and communicating the adapted LCD code value to the LCD modulator to set the transmittance level of said at least a part of the LCD modulator according to the adapted LCD code value.

2. The method of claim 1, wherein the adapted LCD code value is determined as a monotonically decreasing function of the obtained output level value of said at least a part of the backlight.

3. The method of claim 1, wherein the adapted LCD code value is determined as a monotonically increasing function of the obtained output level value of said at least a part of the backlight.

4. The method of claim 1, wherein the obtained output level value of said at least a part of the backlight represents an estimated power level of said at least a part of the backlight.

5. The method of claim 1, wherein determining the adapted LCD code value includes evaluating polynomial functions of the received LCD code value to calculate correction terms to the received LCD code value.

6. The method of claim 1, wherein determining the adapted LCD code value includes retrieving correction terms, to the received LCD code value, from respective one-dimensional look up tables, each look up table listing the respective correction term as a function of the received LCD code value.

7. A computer program product having instructions, stored on non-transitory computer-readable media, wherein the instructions, when executed by a computing device or system, cause said computing device or system to:

receive an image signal comprising an LCD code value for setting a transmittance level of at least a part of an LCD modulator, wherein the received LCD code value corresponds to a target transmittance level on a first response curve giving transmittance levels as a function of LCD code values for said at least a part of the LCD modulator when illuminated by at least a part of a backlight at a reference output level thereof;

obtain an output level value of said at least a part of the backlight;

determine an adapted LCD code value as a function of the received LCD code value and the obtained output level value, such that the adapted LCD code value corresponds to the target transmittance level on a second response curve giving transmittance levels as a function of LCD code values for said at least a part of the LCD modulator when illuminated by said at least a part of the backlight at the obtained output level value, the output level value being different from the reference output level such that the second response curve is different from the first response curve; and communicate the adapted LCD code value to the LCD modulator to set the transmittance level of said at least a part of the LCD modulator according to the adapted LCD code value.

8. Control hardware for a display, the display comprising an LCD modulator and a backlight, the control hardware being configured to:

receive an image signal comprising an LCD code value for setting a transmittance level of at least a part of the LCD modulator, wherein the received LCD code value corresponds to a target transmittance level on a first response curve giving transmittance levels as a function of LCD code values for said at least a part of the LCD modulator when illuminated by at least a part of the backlight at a reference output level thereof;

obtain an output level value of said at least a part of the backlight;

determine an adapted LCD code value as a function of the received LCD code value and the obtained output level value, such that the adapted LCD code value corresponds to the target transmittance level on a second response curve giving transmittance levels as a function of LCD code values for said at least a part of the LCD modulator when illuminated by said at least a part of the backlight at the obtained output level value, the output level value being different from the reference output level such that the second response curve is different from the first response curve; and communicate the adapted LCD code value to the LCD modulator to set the transmittance level of said at least a part of the LCD modulator according to the adapted LCD code value.

9. The control hardware of claim 8, wherein the adapted LCD code value is determined as a monotonically decreasing function of the obtained output level value of said at least a part of the backlight.

10. The control hardware of claim 8, wherein the adapted LCD code value is determined as a monotonically increasing function of the obtained output level value of said at least a part of the backlight.

11. The control hardware of claim 8, wherein the obtained output level value of said at least a part of the backlight represents an estimated power level of said at least a part of the backlight.

12. The control hardware claim 8, wherein determining the adapted LCD code value includes evaluating polynomial functions of the received LCD code value to calculate correction terms to the received LCD code value.

13. The control hardware of claim 8, wherein determining the adapted LCD code value includes retrieving correction terms, to the received LCD code value, from respective one-dimensional look up tables, each look up table listing the respective correction term as a function of the received LCD code value.

14. A display comprising an LCD modulator, a backlight and the control hardware of claim 8.

* * * * *